US006656048B2

(12) United States Patent
Olsen

(10) Patent No.: US 6,656,048 B2
(45) **Date of Patent: *Dec. 2, 2003**

(54) CONTROLLER-BASED LINKED GAMING MACHINE BONUS SYSTEM

(75) Inventor: Eric Burton Olsen, Henderson, NV (US)

(73) Assignee: Mikohn Gaming Corporation, Las Vegas, NV (US)

( * ) Notice: Subject to any disclaimer, the term of this patent is extended or adjusted under 35 U.S.C. 154(b) by 422 days.

This patent is subject to a terminal disclaimer.

(21) Appl. No.: 09/775,206

(22) Filed: Feb. 1, 2001

(65) Prior Publication Data

US 2001/0004607 A1 Jun. 21, 2001

Related U.S. Application Data

(63) Continuation of application No. 09/399,459, filed on Sep. 17, 1999, now Pat. No. 6,217,448.

(60) Provisional application No. 60/101,051, filed on Sep. 18, 1998, and provisional application No. 60/101,504, filed on Sep. 23, 1998.

(51) Int. Cl.[7] ..... A63F 9/22

(52) U.S. Cl. ..... 463/25; 463/30; 463/42

(58) Field of Search ..... 463/16, 17, 18, 463/19, 20, 25, 26, 30, 42; 273/138.1, 138 R, 138 A, 143 R

(56) References Cited

U.S. PATENT DOCUMENTS

| | | | |
|---|---|---|---|
| 4,258,838 | A | 3/1981 | Rockola et al. |
| 4,283,709 | A | 8/1981 | Lucero et al. |
| 4,335,809 | A | 6/1982 | Wain |
| 4,467,424 | A | 8/1984 | Hedges et al. |
| 4,624,459 | A | 11/1986 | Kaufman |
| 4,636,951 | A | 1/1987 | Harlick |
| 4,652,998 | A | 3/1987 | Koza et al. |

(List continued on next page.)

FOREIGN PATENT DOCUMENTS

| | | |
|---|---|---|
| AU | B-27572/84 | 11/1984 |
| AU | B-53370/86 | 8/1986 |
| AU | B-71194/91 | 8/1991 |

(List continued on next page.)

OTHER PUBLICATIONS

"SuperLink, Premier Slot Merchandising System", Mikohn Winning Solutions . . . Worldwide, Mikohn Gaming Corporation, Las Vegas, NV.

(List continued on next page.)

*Primary Examiner*—Jessica Harrison
(74) *Attorney, Agent, or Firm*—Dorr, Carson, Sloan & Birney, P.C.

(57) ABSTRACT

A method for providing bonus jackpot payoffs during a bonus mode time period in a system of linked gaming machines interconnected to a controller. Eligible gaming machines are determined at the time the bonus time period starts. Once the bonus mode time period starts, a portion of the eligible gaming machines are randomly selected for multiple jackpot bonus payoff opportunities. The random selection determines the rate the opportunities are issued and the average length of the bonus mode time period. Once gaming machines are selected they are allowed to complete the game they are currently involved in and should the play result in a winning combination, then the game payoff is multiplied by a bonus multiplier. The underlying gaming machine is responsible, in a conventional fashion, for paying the game payoff and the controller then authorizes a further jackpot bonus payoff of the bonus multiplier less one times the game payoff. The bonus pool value is then decremented by the amount paid by the controller. This process repeats until the bonus mode multiplier opportunities for each bonus multiplier in each bonus round is completed or until the bonus pool value drops below zero.

25 Claims, 13 Drawing Sheets

U.S. PATENT DOCUMENTS

| | | | |
|---|---|---|---|
| 4,669,731 | A | 6/1987 | Clarke |
| 4,679,143 | A | 7/1987 | Hagiwara |
| 4,775,937 | A | 10/1988 | Bell |
| 4,805,907 | A | 2/1989 | Hagiwara |
| 4,837,728 | A | 6/1989 | Barrie et al. |
| 5,042,809 | A | 8/1991 | Richardson |
| 5,048,833 | A | 9/1991 | Lamle |
| 5,078,405 | A | 1/1992 | Jones et al. |
| 5,116,055 | A | 5/1992 | Tracy |
| 5,217,224 | A | 6/1993 | Sincock |
| 5,241,379 | A | 8/1993 | Tsujita |
| 5,249,800 | A | 10/1993 | Hilgendorf et al. |
| 5,257,179 | A | 10/1993 | DeMar |
| 5,265,874 | A | 11/1993 | Dickinson et al. |
| 5,275,400 | A | 1/1994 | Weingardt et al. |
| 5,280,909 | A | 1/1994 | Tracy |
| 5,326,104 | A | 7/1994 | Pease et al. |
| 5,344,144 | A | 9/1994 | Canon |
| 5,370,306 | A | 12/1994 | Schulze et al. |
| 5,401,024 | A | 3/1995 | Simunek |
| 5,429,361 | A | 7/1995 | Raven et al. |
| 5,470,079 | A | 11/1995 | LeStrange et al. |
| 5,472,194 | A | 12/1995 | Breeding et al. |
| 5,560,601 | A | 10/1996 | Yamazaki et al. |
| 5,564,700 | A | 10/1996 | Celona |
| 5,580,309 | A | 12/1996 | Piechowiak et al. |
| 5,611,730 | A | 3/1997 | Weiss |
| 5,626,341 | A | 5/1997 | Jones et al. |
| 5,645,486 | A | 7/1997 | Nagao et al. |
| 5,655,961 | A | 8/1997 | Acres et al. |
| 5,766,074 | A | 6/1998 | Cannon et al. |
| 5,772,509 | A | 6/1998 | Weiss |
| 5,833,538 | A | 11/1998 | Weiss |
| 5,855,515 | A | 1/1999 | Pease et al. |
| 5,876,284 | A | 3/1999 | Acres et al. |
| 5,885,158 | A | 3/1999 | Torango et al. |
| 5,941,773 | A | 8/1999 | Harlick |
| 5,989,121 | A | 11/1999 | Sakamoto |

FOREIGN PATENT DOCUMENTS

| | | |
|---|---|---|
| AU | B-10488/92 | 7/1992 |
| AU | B-21070/92 | 10/1993 |
| AU | B-36472/95 | 5/1996 |
| AU | A-43615/97 | 7/1998 |
| GB | 2 151 054 A | 7/1985 |
| GB | 2 201 279 A | 8/1988 |
| GB | 2 211 975 A | 7/1989 |
| JP | 406142274 A | 5/1994 |
| WO | WO 95/22811 | 8/1995 |
| WO | WO 97/12338 | 4/1997 |
| WO | WO 97/49073 | 12/1997 |

OTHER PUBLICATIONS

John Acres, Gaming Innovations Concept III, circa Mar. 1993, 18 pages.

Form SB–2 Registration Statement Under the Securities Act of 1933, Sep. 20, 1993, 51 pages—Acres Gaming.

PCT International Search Report, Mar. 15, 1999, 3 pages.

PCT International Search Report, May 24, 2000, 4 pages.

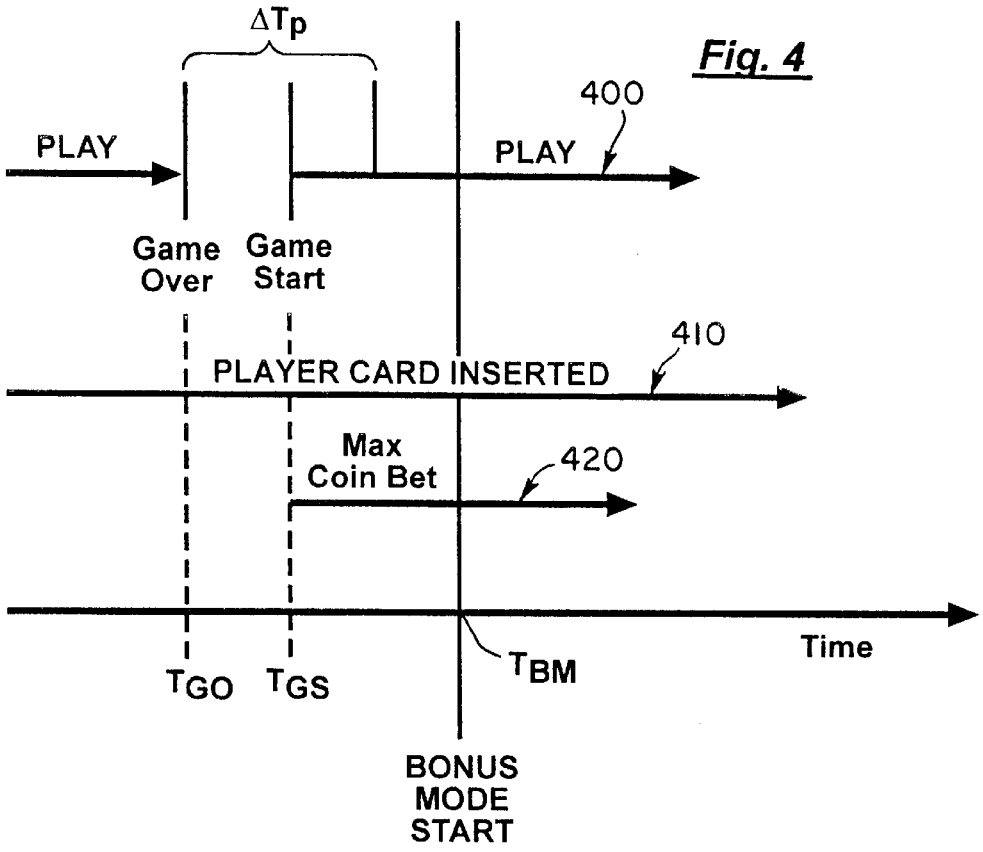
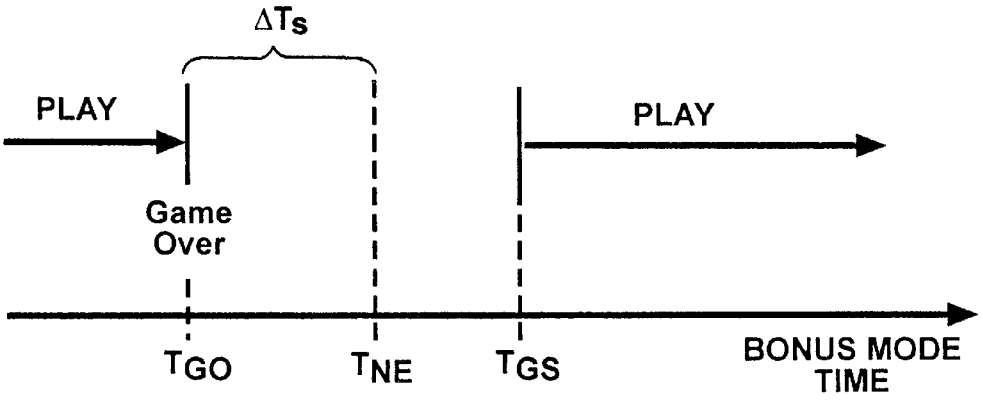
Fig. 5

START
900

Select Random Jackpot Trigger Value
910
Wait For Coin-In Amount
920
Contribute to Current Value
930
975
Normal Coin-In
965
940
In Bonus Mode ?
Yes
Gaming Machine Eligible ?
No
950
No
970
Yes
No
Trigger ?
Got a Potato ?
No
960
Yes
980
Yes
982
Enter Bonus Mode
Bonus Win ?
Yes
Adjust Current Value
No
984
Yes
Current > 0 ?
No
BO Count = 0 ?
985
Yes
992
990
Next Round
No
Last Round ?
Bonus Mode End
986
Yes

CONTROLLER-BASED LINKED GAMING MACHINE BONUS SYSTEM

RELATED INVENTIONS

This application claims priority to Ser. No. 09/399,459 now U.S. Pat. No. 6,217, 448, entitled "CONTROLLER-BASED LINKED GAMING MACHINE SYSTEM," filed on Sep. 17, 1999 and which claims priority to two provisional patent applications, Ser. No. 60/101,051 filed Sep. 18, 1998 and Ser. No. 60/101,504 filed Sep. 23, 1998, both entitled "CONTROLLER-BASED LINKED GAMING MACHINE BONUS SYSTEM."

BACKGROUND OF THE INVENTION

1. Field of the Invention

This invention relates to gaming machines and, in particular, to controller-based linked gaming systems.

2. Statement of the Problem

Gaming machines are well known and include a variety of games such as slot, poker, and keno. Gaming machines can also be programmed to play a variety of games. Players insert monetary amounts by inserting coin, token, paper currency, or magnetic card; pushing credit buttons; or other suitable entry of monetary value to play one or more games on a particular gaming machine. Such monetary amounts are usually translated into a number of units of the lowest unit of currency receivable by the machine, referred to herein as the unit bet. Such operation is well known in the art.

Upon entry of a monetary amount, the gaming machine determines therefrom which games and/or payoffs the player qualifies for based upon an internal game in the machine and on an associated internal pay table in the machine. The player is then normally required to take some action to institute playing of the game such as pushing a play button or pulling a lever arm. The player then plays the game according to the rules of the game. The player either wins the game or loses the game. If the player wins the game, the player is given the payoff established by the gaming machine for the particular game being played. This payoff varies considerably from type of game played to the type of winning combination in the rules of the game. Typically, the payoff is a return of monetary amounts equal to or in excess of the monetary amounts entered to play the game. Winning or losing the game completes the gaming cycle. If the player loses the game, the player typically loses the amount wagered and there is no payoff. The gaming machine then conditions itself so as to be able to again receive monetary amounts to begin another game cycle and the process repeats. Such individual stand-alone conventional gaming machines are found in numerous casinos throughout the world and are made by a number of different manufacturers. Conventional gaming machines include a variety of different slot machines (video or mechanical), poker, keno, etc.

In order to attract more players to such gaming machines, progressive gaming systems were developed. Progressive gaming systems permit the player to play individual gaming machines as discussed above. To add to the excitement of play, the individual gaming machines are linked together to allow players to compete for an additional common award or "progressive jackpot." The progressive jackpot award can amount to a substantial amount of money. Progressive gaming systems are also found in casinos throughout the world. In some environments, the progressive jackpot award is an expensive vehicle, such as a motorcycle or sports car. In progressive gaming systems, a programmed controller is provided for linking the machines together. The controller receives the unit bets from the linked machines as well as machine identification information from each machine and supplies to the players, either through displays provided on their respective machines and/or a common overhead display, information as to the common progressive jackpot.

In one type of progressive system, the controller controls the progressive game during each progressive game cycle by first establishing a jackpot-win amount in a random manner between maximum and minimum jackpot values. The controller has an internal random number generator for making this random selection. The controller also establishes a base value which is used as an initial amount for a current progressive jackpot amount, which is the progressive jackpot amount reported by the controller to the machine displays and/or the overhead display and display to the players. The current jackpot amount is recalculated or incremented by the controller each time a game is played at each gaming machine. The controller does this by adding to the current progressive jackpot amount an increment value based on the number of unit bets entered at the individual gaming machines in the progressive gaming system multiplied by a fixed progressive increment rate per unit bet. This is a continuous process since players at different machines are inserting monetary amounts to start game play at different times.

To this end, each gaming machine, as above indicated, reports its unit bet information to the controller or a communication link upon a player playing the gaming machine so that the current progressive jackpot value can be appropriately incremented. The gaming machine is also identified with conventional signaling to the controller with the bet information so that the controller knows which gaming machine resulted in the increment.

After each increment of the current progressive jackpot, the controller compares the new current jackpot value with the jackpot-win value, which it previously randomly established and stored. If the new value is less than a jackpot-win value, the controller merely updates the current jackpot value and communicates the updated value to the displays at the gaming machines and/or the overhead display. The controller then continues to monitor the unit bet information indicative of game play from the gaming machines and to increment the current progressive jackpot value based thereon.

When an increment to the current jackpot value causes the value to reach or become equal to the jackpot-win value, the controller determines that the jackpot has been won by the gaming machine, which resulted in the aforesaid increment. The controller communicates this to the winning gaming machine and the appropriate payment of the jackpot-win amount is made to the player. This suddenly surprises the player as it comes unexpectedly and adds excitement to the game.

After a jackpot has been won, the controller then institutes a new progressive game cycle in which it resets the progressive jackpot by randomly selecting, from values between the maximum and minimum jackpot values, a new jackpot-win value. The controller then also resets the current jackpot value to the base value and begins incrementing this value based on the fixed progressive increment. As before, this incrementing continues until the current jackpot value reaches the newly selected progressive jackpot-win value and the progressive jackpot is won again. The controller then repeats the progressive game cycle based on continued game play, as described above. The above type of linked random jackpot controller-based systems have been sold by the assignee of the present invention under the trademark MYSTERY JACKPOT and, for example, is discussed in U.S. Pat. No. 5,280,909. The '909 patent specifically teaches that the jackpot payout need not be a fixed jackpot-win value and that the award could be issued based upon conditions at the machine and paid when the next winning combination occurs at the machine. For example, the payout criteria might be to payout a jackpot equal to the award for the next winning combination established at the machine.

Another prior art slot promotion is called "Double Jackpot Time." Here, all gaming machines that are eligible receive "double jackpots" (i.e., 2×) for a period of time. At first, these "double jackpots" were manually operated by an attendant. To eliminate the cost of personnel, the double jackpots became automated. Variations arose including 3× and 5× pays. These conventional bonusing games are unpredictable from a casino-funding viewpoint and are usually short in duration—especially for the 3× and 5× pays. A need exists to manage both time-wise and finance-wise the bonus time for such games.

A need exists to improve upon the above progressive gaming system and the conventional "Double Jackpot" bonus games to attract players, to retain players at the gaming machine by extending play, and to add more excitement in playing the progressive gaming system. A need exists to extend the time period for "Double Jackpot Time" without bankrupting the system. A need exists to heighten player anticipation during "Double Jackpot Time" type bonus games. A need also exists to provide players with a feeling of group participation as they play a progressive game. A need further exists to provide regulation of the award of bonus jackpots during the bonus mode time period with respect to time of play and depletion of the bonus pool. A need finally exists to provide this form of regulation yielding stable system expectations.

SUMMARY OF THE INVENTION

1. Solution to the Problem

The present invention addresses the system expectation and performance ability needs set forth above to achieve regulation of both time of play and depletion of the bonus pool while providing a growing excitement among the players during the bonus time mode. In one preferred embodiment, the system of the present invention provides bonus multipliers that increase through successive bonus rounds. The system of the present invention regulates the number of bonus multiplier opportunities issued group wide for each bonus multiplier round. Hence, regulation and stabilization occurs by controlling the number of bonus rounds, the actual value of the bonus multiplier used in each round, the number of games (i.e., bonus multiplier opportunities) to be played in each bonus round using a given bonus multiplier, and the rate at which bonus multiplier opportunities are issued. Controlling the aforesaid factors provides control over the average duration of the bonus mode time period, the expected number of bonus rounds, the average expectation of entering each bonus round, the average number of game winners, and the average amount of bonus jackpot awards made. All of this is controlled by the controller connected to all of the linked gaming machines without interference with the standard play of the underlying game and the award of payouts based upon the internal pay table at each gaming machine.

2. Summary of the Invention

A method is set forth for providing bonus jackpot awards during a bonus mode time period in a system of linked gaming machines interconnected to a controller. The method preferably starts the bonus mode time period in a conventional fashion such as when a bonus pool reaches a monetary value. Eligible gaming machines are preferably determined at the time the bonus time period starts. Once the bonus mode time period starts, a portion of the eligible gaming machines are randomly selected for bonus multiple opportunities. The random selection determines the rate the bonus multiple opportunities are issued. Those selected eligible gaming machines are then allowed to complete their games and should such play result in winning combinations, then the conventional payoffs are multiplied by the bonus multiplier corresponding to the bonus multiplier opportunity. The underlying gaming machine is responsible, in a conventional fashion, for paying the game payoff and the controller then authorizes a bonus jackpot payoff based upon the bonus multiplier less one times the game payoff. The bonus pool value is then decremented by the value of the bonus jackpot payoff. This process repeats until the bonus multiplier opportunity for each bonus multiplier in each bonus round is completed or until the bonus pool value drops preferably below zero. The provision of a fixed number of bonus rounds, the value of a bonus multiplier for each round, a predetermined number of bonus multiplier opportunities for each of the fixed number of bonus rounds and a random selection rate for each bonus round allows the operator of the system of the present invention to control the average duration of the bonus mode time period as well as the financial expectations of the bonus game. The setting of the random selection rate by the operator controls the frequency that eligible machines are selected thereby directly controlling the average duration of the bonus mode time period. A number of preferred embodiments and variations thereof are presented herein based upon the above control items.

BRIEF DESCRIPTION OF THE DRAWINGS

FIG. 4 sets forth an illustration of the determination of eligibility under an embodiment of the present invention.

FIG. 5 sets forth an illustration of the timing of secondary eligibility during the bonus mode time period.

DETAILED DESCRIPTION OF THE INVENTION

1. Overview

Figure 1:
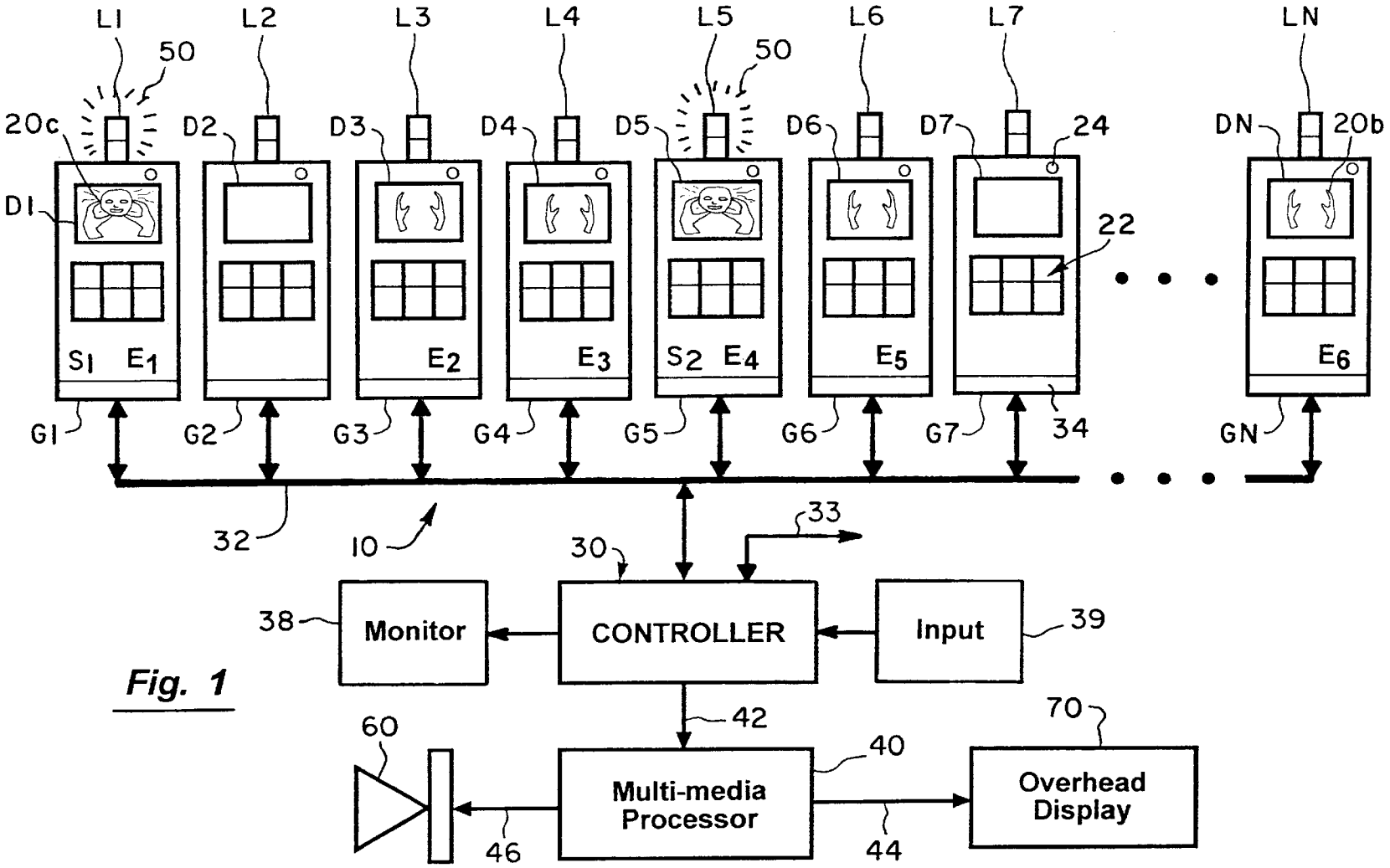
FIG. 1 is a block diagram representation of a preferred embodiment of the controller-based linked gaming machine bonus system of the present invention.

The bonus system 10 of FIG. 1 is a controller-based linked gaming machine bonus system that connects a plurality of gaming machines G to provide jackpot bonuses to eligible gaming machines E during distinct bonus mode time periods. Jackpot bonus payouts are made to randomly selected eligible gaming machines S and provide a multiple based upon the outcome of a game (or optionally, series of games) played. Therefore, the jackpot bonus payouts are directly tied to the payout of the base or underlying game played in selected eligible gaming machines S.

In FIG. 1, the letter "G" denotes all linked gaming machines (i.e., G1 through GN in the system 10); the letter "E" denotes only those gaming machines G that are being played and eligible when the bonus mode time period starts (e.g., E1 through E6); and the letter "S" denotes only those eligible gaming machines E that are randomly selected during the bonus mode time period to qualify for a jackpot bonus payoff (i.e., S1 and S2). Any number of gaming machines G can be used in the system 10.

The gaming machines G are interconnected to a controller 30 over a communication network 32 which could be any suitable serial or parallel bus arrangement. Indeed, any communication link 32 could be utilized under the teachings of the present invention and the controller 30 could be located remotely from the gaming machines G. At each gaming machine G is an interface card 34 which interfaces between the conventional electronic circuitry of the gaming machine G and the communication network 32. It is to be expressly understood that each gaming machine G can be any suitable game such as slot machines, video poker machines, video keno machines, etc. In other words, the teachings of the present invention are not limited to a slot machine which is illustrated in FIG. 1 as having slots 22. The design and operation of slot machines is well known and conventional slot machines are available such as from International Gaming Technology and Bally. Furthermore, the controller 30 can be any suitable computer-based controller. Again, the actual controller 30 used can be any of a number of different controllers and computer based processing systems. How the controller 30 communicates with each gaming machine G over the communication network 32 is a matter of design choice and the protocols of communication are determined by the nature of the communication network 32 and the corresponding interface circuits 34. The controller 30 may optionally be connected over communication link 33 to another computer system, not shown. Furthermore, the network 33 in some embodiments is a telecommunications network such as a phone link, intranet, Internet, satellite, etc. In these embodiments, the gaming machines are implemented as game software in personal computers which are located in remote locations such as hotel/motel rooms, homes, etc. Hence, what follows is a discussion of the functional operation of the controller-based linked gaming machine bonus system 10 of the present invention in the preferred environment of a casino.

In FIG. 1, each conventional gaming machine G, in addition to having the interface circuitry 34 added, also has added a display D, a tower lamp L, and a speaker 24. The display D and the speaker 24 provide visual and audible indications to a player at a gaming machine G. In addition, the controller 30 is further interconnected over lines 42 to an optional multimedia presentation processor 40 which in turn controls an overhead display 70 over lines 44 and a speaker or sound system 60 over lines 46. It is to be expressly understood that the multimedia presentation processor 40 is conventionally available and is designed specifically to provide multimedia presentations from suitable database memories contained therein or any of a number of different types of overhead displays 70 and speaker or sound systems 60. Again, the actual design and construction of the multimedia presentation processor 40, the sound system 60, and overhead display 70 can be any of a number of equivalent designs. Indeed, the controller 30 can be designed to perform the role of the multimedia presentation processor 40 thereby eliminating the additional costs of a separate processor 40. In which case, the controller 30 would directly drive the overhead display 70 and the sound system 60.

The words POTATO and HOT POTATO as well as the designs of a "potato" and "hands" are all intended to be trademarks of the controller-based linked gaming machine bonus system 10 of the present invention and are used throughout to illustrate the present invention. It is to be expressly understood that any other theme, concept, words, symbols, and/or characters could also be utilized as designs to implement the bonus game of the present invention. Any suitable design could be utilized to indicate "eligibility," "bonus eligibility," and "jackpot payoff" to players during the various phases of play occurring in the bonus game of the present invention. Such design indicators visually shown to players in displays D immediately inform the players as to their status in the bonus game. In FIG. 1, displays D1 thru DN are shown.

To become eligible for the bonus mode time period, a player must preferably play for a predetermined amount of time at a gaming machine G before the bonus mode triggers. This ensures that bystanders are not unfairly entitled to participate by simply waiting for the bonus mode to trigger. Furthermore, the system 10 can optionally invoke other eligibility requirements such as maximum coin play and/or the insertion of a player card as will be discussed. Any suitable eligibility requirements can be used.

Another feature of the system 10 is the use of visual indicators 200, 20(*a*), 20(*b*), and 20(*c*) in the bonus mode as illustrated in FIGS. 2(*a*), 2(*b*), 2(*c*) and 2(*d*). This is accomplished using a set of graphical "hands" depicted on the game display D placed before each player as shown in FIGS. 2(*b*), 2(*c*), and 2(*d*). The graphical hands 20 immediately convey bonus information during the bonus period. Before the bonus mode starts, players see text messages 200 in display D such as: "Not Eligible" or "Eligible." Graphics may accompany the text 200. In the bonus mode, machines that are not eligible have the display D with hands down 20*a* as shown in FIG. 2(*b*). This immediately conveys that such players cannot participate in the bonus mode. Graphical conveyance of eligibility is a feature of this system. Eligibility status on prior art games have relied on lights and text messages, which may be unclear to participants.

Once in bonus mode, players must play to catch the potato C. This is conveyed graphically as well, and represents another feature of the system. Once the bonus mode time period is started, the display D for all eligible players shows the hands immediately move to an "up position" 20*b* so as to be ready to catch a potato as shown in FIG. 2(*c*). If the eligible gaming machine E is then selected S to catch the potato C, the display D will show the potato being caught by the hands 20*c* during game play as shown in FIG. 2(*d*). The selected gaming machine S is then allowed to complete the underlying game at the gaming machine S and the players may be awarded a multiple of the winning payoff, if any. These graphical displays allow a player to immediately and easily understand the bonus game.

The bonus mode of the present invention consists of up to eight separate bonus rounds, BR. Each bonus round BR represents a particular multiplier value, BM, and each bonus round BR has a static or fixed number of bonus multiplier opportunities, BO. These are only "bonus multiplier opportunities" BO since whether or not a bonus jackpot payoff is given is entirely dependent upon the outcome of the underlying game in the gaming machine G. If no winning combination is obtained in the gaming machine S, there is no bonus jackpot payoff given as there is no game payoff. Preferably, the first round will start with the lowest bonus multiplier, BM, and each successive round will increase the value of the bonus multiplier BM. The effect of breaking up the bonus mode time period into bonus rounds BR is to create a heightening effect for the players. As each bonus round BR is entered, the possibility of hitting a larger jackpot is significantly increased. For example, a game payout of 6 coins at a selected eligible gaming machine S will pay 12 coins when BM=2×, but will pay 180 coins when BM=15×. Preferably, the number of bonus opportunities BO in each higher round is less than those played in the first bonus rounds. Players feel that time is of the essence, since bonus multipliers BR get larger in each successive round, but bonus opportunities BO to receive a bonus multiplier BM are getting smaller.

In the preferred embodiment, a set number of bonus rounds BR is provided and the set number can be any suitable value such as one or greater. Indeed, the teachings of the present invention could provide only one bonus round BR. Furthermore, while the preferred embodiment provides values for the bonus multipliers BM that increase for each round, it is to be expressly understood that such values for the bonus multiplier BM could remain the same, decrease, or be randomly selected for each successive bonus round BR (or any combination thereof). Finally, while the preferred embodiment provides a set number of bonus multiplier opportunities BO for each bonus round BR that decreases with the next bonus round BR, it is to be expressly understood that the set number for the bonus opportunities BO could remain the same, increase or be randomly selected in each bonus round BR (or any combination thereof).

The termination of the bonus mode time period can happen at any time. This is due to the fact that a bonus pool is used to finance the jackpot bonus payoffs that are made during the bonus mode period. As long as this bonus pool stays solvent, the bonus mode will continue. In some cases, the bonus mode time period will reach the last bonus round BR. The last bonus round BR will continue indefinitely until the bonus pool is exhausted. However, if a lucky player hits a large jackpot bonus payoff during any previous bonus round BR, it is possible that this bonus jackpot payoff depletes the bonus pool and thus terminates the bonus mode time period. Termination of the bonus mode occurs when the bonus pool is depleted and/or drops below zero.

In the bonus mode time period and in the preferred embodiment, a special fanfare period is created between bonus rounds BR in displays D and 70. In other words, once the system 10 has exhausted all bonus jackpot multiplier opportunities for a particular bonus round BR, then a special fanfare mode is activated by the controller 30 that lasts in a preferred range of about five to ten seconds. In this bonus round transition mode, the displays D and 70 and/or speakers 24 and 60 pre-announce the next bonus round BR and the new bonus multiplier BM to advertise the exciting fact that another bonus round will be entered. In some variations of the present invention, this is optional.

Regulating the controller-based linked gaming bonus system 10 is another feature of the present invention. In order to support a stable operation, the preferred embodiment of the present invention requires the operator to pre-configure the system to award a set number of bonus multiplier opportunities BO link-wide for each bonus round BR. Preferably, the predetermined number of bonus multiplier opportunities BO (i.e., potatoes in our continuing example) issued in each round is static, but different, and generally decreases as the bonus multiplier BM is elevated with the next bonus round BR. The predetermined number of bonus multiplier opportunities BO issued for each bonus round BR is preferably independent of the number of eligible gaming machines E or the actual number of total games played. This predetermined number for BO is also highly dependent on the linked game's percentages and paybacks as well as the operator's requirements and considerations for bonus behavior. The system 10 of the present invention is flexible as it can be tailored for many types of system behaviors and expectations by the operator.

The controller-based linked gaming bonus system 10 preferably relies on two types of display technologies: an in-machine display D and an overhead display 70. The in-machine display D typically interacts with the player during specific events, informing them of their eligibility status, their bonus multiplier opportunity status, and their win status. The overhead display 70 typically informs the entire carousel and by-standers of the carousel area mode, the bonus round transition mode, and other advertising and attract sequences.

As shown in FIG. 1, selected eligible gaming machines S are lit 50 with a neon tower lamp L (i.e., lamps L1 through LN). When the lamp L is lit 50, that player holds a hot potato C in hands 20*c* in display D, as the player is entitled to receive a multiplied payoff on a designated payoff won in the conventional game play. Hence in the illustration of FIG. 1 the selected gaming machines S1 and S2 have a visual indicator 20*c* of hands holding a potato (i.e., a bonus multiplier opportunity BO). The games being played in G1 and G5 are continued to completion and, if a game payoff occurs, the player also receives a multiple of the payoff as a bonus as will be explained later. The remaining unselected, but eligible gaming machines E2, E3, E5 and E6 in FIG. 1 have hands open graphics 20*b* displayed in displays D. The action continues to heat up as the bonus multiplier BM is increased in each bonus round BR of the bonus mode time period. The lamp L differentiates the bonus rounds BR using three colors in one preferred embodiment: yellow for double jackpot mode, orange for triple jackpot mode, red for five times pay mode, and combinations of colors for 10× (i.e., yellow and red), 15× (i.e., orange and red), and 30× (i.e., yellow, orange, and red) bonus multipliers.

Once the bonus mode time period begins, the tower lamps L will turn yellow over a predetermined number such as one-third of all gaming machines G, and begin rotating across all gaming machines G in the carousel, as will be discussed later. This adds further visual excitement to the bonus mode time period. It appears that hot potatoes C are moving from one machine E to another. The loudspeaker 60 will play sounds of a character catching hot potatoes while moaning and groaning! In this mode, eligible gaming machines E are selected for bonus jackpots with a high degree of fanfare called the "hot potato exchange." Without warning, the tower lamps L stop at randomly selected eligible machines S. These selected gaming machines S now hold a hot potato (i.e., representing bonus opportunity BO to obtain a jackpot bonus based upon a bonus multiple BM and the game payout, if one is won) and the respective players know this since their tower lamp L is lit steady 50 and their local displays D have hands 20*c* holding a sweating potato character C. The fanfare motion is an attract feature only. A light freezes ON when selected by a random function. Alternatively, the fanfare motion only exists during Bonus Mode transitions.

When a selected machine S holds a hot potato 20*c* in display D, the current underlying game completes and any payoff received from the game is increased by the bonus multiplier BM, as will be explained.

In the preferred embodiment, at the start of each successive bonus round BR players enjoy a fanfare multimedia presentation such as, for example, the following showing increased bonus multipliers BM as the overhead display 70 shows a "hot potato" that's getting hotter by the second. Players sense that time is growing short so they play as fast as possible. Spectators sense that something will happen next. Then, without warning, the hot potato flares up in the overhead display 70 as loudspeaker 60 announces the bonus multiplier BM for the next bonus round, such as three times pay! The loudspeaker 70 exclaims, "These machines are getting hot, . . . triple times pay hot, but only if you get a 3 times hot potato!" Potatoes C begin rotating around machines once again as players now desire a potato more then ever!

Players again play out the 3 times (i.e., BM=3) bonus round in hopes of landing some big cash awards. Players sense that their opportunity is growing short as each bonus round BR creates ever more fantastic bonus opportunities BO, but to fewer and fewer lucky players. After several moments, the cycle repeats for the next bonus round BR and the potatoes C begin to rotate across the gaming machines G, looking for the next round of lucky players. The loudspeaker 60 exclaims "These machines are getting super hot, . . . 5 times pay hot, . . . but only if you got a red hot potato!" As the seconds pass, the tower lamps L lock in and light on new selected machines S and lucky players play for 5 times pay. All the players excitement and expectations rise, as they all hope they will be chosen in the next bonus round, 10 times pay and beyond! They better keep their hands up cause they never know when they are going to catch a hot potato!

What is presented above is an overview of one illustration of the present invention using a preferred embodiment of displays D and 70, speakers 24 and 60, and lamps L to create multimedia fanfare for the system 10 of the present invention. The teachings contained herein are not limited to the arrangement shown in FIGS. 1 and 2 and any number of equivalent multimedia presentations could be utilized to provide such fanfare.

2. Method of Financing the Bonus Mode

The system 10 is financed as in the conventionally available MONEYTIME system and as disclosed in U.S. patent application Ser. Nos. 08/957,076, filed 10/24/97 and 09/052,047, filed 3/30/98. That is, a bonus pool is preferably created from a contribution of all coins wagered at gaming machines G. Furthermore, two limits are set, a low limit and a high limit. The controller 30 randomly chooses a secret number between these two limits after completion of a bonus mode time period. When the bonus pool reaches or first exceeds the secret number through such contributions, the bonus mode of the present invention triggers (i.e., commences). The bonus pool is used to finance all bonus jackpot payoffs made during the bonus mode time period. Depletion of the bonus pool below the low level (such as zero) triggers an end to the bonus mode. Also, the bonus pool is allowed to go negative to regulate expected volatility of payments made in each bonus mode of the present invention. The teachings contained herein can use bonus pools funded by other conventional approaches such as, but not limited to, separate wagers, hidden pools, casino contributions, etc.

Figure 3:
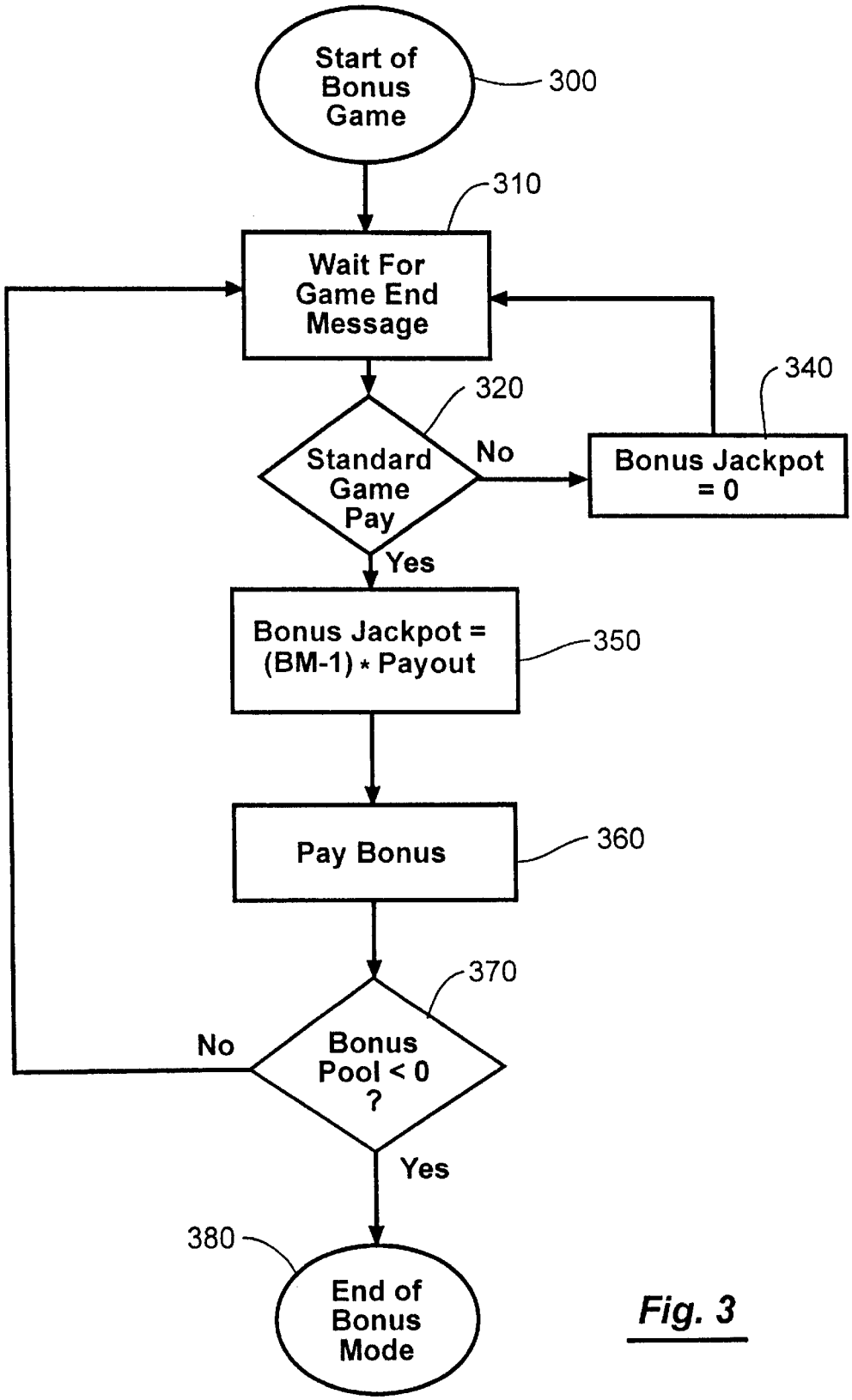
FIG. 3 represents a functional flow chart for determining the awarding of a bonus jackpot during the bonus mode time period of the present invention.

FIG. 3 is a functional flowchart for software in controller 30. As shown in FIG. 3, the bonus mode time period starts (i.e., randomly) in stage 300, bonus jackpot payoffs are awarded by the controller 30 in response to standard gaming machine payouts. In particular, a bonus multiplier value, BM, is used to determine the amount of the bonus jackpot payoff. For example, a 2× bonus multiplier (i.e., BM=2) will indicate that the controller 30 matches the game payoff of the selected gaming machines S. A 3× multiplier (i.e., BM=3) will indicate that the controller 30 should pay an additional two times the game payoff paid by the selected gaming machine S. To the player, the selected machine S is seen to multiply the standard payout value by the bonus multiplier BM and pay that as a single award to the player. The actual amount paid by the controller 30 is always the bonus multiplier BM minus one times the value of the standard game payoff in the game (i.e., (BM−1)×payoff). The combined payout is credited in a conventional fashion at the player's machine.

FIG. 3 sets forth the functional flow chart for determining bonus multiplier opportunities BO by the controller 30 to randomly selected eligible gaming machines S in the bonus game of the present invention. In stage 300, the bonus mode time period randomly commences. At this point in time, a bonus pool of money exists as is conventionally determined to fund the bonus jackpots. As discussed above, the bonus pool is equivalent to the random value between the low and high limits set. As shown in FIG. 2, those selected gaming machines S in a bonus round BR having caught a hot potato 20*c* as shown in FIG. 2(*d*) are allowed to participate in receiving possible bonus jackpot payoffs. How eligible gaming machines E are selected for each bonus round BR will be discussed later.

The amount of the bonus jackpot payoff that the participating selected gaming machine S pays is dependent upon the outcome of the underlying game that is played. Players at non-eligible gaming machines (e.g., G2 and G7 in the illustration of FIG. 1) do not participate in the opportunity to receive bonus jackpot payoffs, but can still play the conventional underlying game.

Hence, each of selected gaming machines S must complete their pending games which occurs at different times in a bonus round BR. Hence, the controller 30 waits in stage 310 for a conventional game end message from a selected gaming machine S. When the game end message is received by the controller 30 over network 32, then in stage 320 a determination is made by the controller 30 whether or not a bonus jackpot payoff is made. If the selected gaming machine S finishes the game with no win (i.e., no payout), then stage 340 is entered indicating that the bonus jackpot payoff equals zero and the system returns to stage 310 to await the next game end message from the next selected gaming machine S. If in stage 320, the game end results in a conventional payout based upon a conventional winning combination in the game, then stage 350 is entered.

It is at this stage that the bonus multiplier BM for the given bonus round BR is utilized by the controller 30 to enhance the payout from the selected gaming machine S. The controller 30 uses the bonus multiplier value BM (which is dependent upon the bonus round BR), subtracts one and multiplies it by the payout from the game which could be, for example, coins won. Hence, and by way of example only, a selected gaming machine S at the end of game play results in a payout of ten coins with a bonus multiplier BM of 3×, then the bonus payout is (BM−1)× (payout) or (3−1)×10 coins=20 coins.

In stage 360, the controller 30 of the present invention sends this information over network 32 to instruct the winning selected gaming machine S to pay a bonus jackpot amount in stage 360. In this example, the player sitting at the winning selected gaming machine S actually receives 30 coins, i.e., 10 coins, representing the conventional payout from play and 20 coins as determined by the controller 30. This is a separate determination and that the jackpot bonus payout of 20 coins is independent of the operation of the pay table in the underlying gaming machine. That is the present invention does not alter, reconfigure, or modify the pay table or the payout structure in the conventional gaming machine in the play of the gaming machine. Rather, the game is conventionally played, a game payoff is conventionally generated and based on that information, the controller then determines in FIG. 3, the bonus jackpot payoff to be additionally paid to the winning selected gaming machine S. The bonus payout is paid through the gaming device by a conventional payout command to that game. Because bonus payouts are only made to randomly selected gaming machines S, the present invention is not equivalent to a bonus pay table at the machine. In fact, the present invention is itself a secondary bonus game.

The actual payout of the bonus jackpot payoff (i.e., (BM−1)×(Game Payoff)) could be made separately in some embodiments of the present invention. For example, display D could be a video screen and have a graphic bonus jackpot payoff meter displayed which simply displays the separate bonus award. In which case, the gaming machine G would display the conventional payoff resulting from play of the game in its credit meter. For example, if the game play results in payout of 2 coins and BM=15×, then the conventional game payout display would be 2 coins and the bonus jackpot payoff shown in display D would be (15−1)×2=28 coins. In this example, which is one of many other equivalent approaches, the system 10 would then, subsequently and separately, show the 28 coins in display D decrementing while simultaneously incrementing the credit meter in the conventional gaming machine. Hence, the operation of the underlying game in the selected gaming machine S is entirely separate from the operation of the bonus system of the present invention. And, the player sitting at the winning selected gaming machine S not only witnesses the conventional payout from winning the game being made, but would also witness the separate bonus jackpot payoff and then the combining of the two into the credit meter after the conventional game payout occurred. In another embodiment, the bonus payoffs would simply accumulate until the bonus mode time period ends at which time a transfer (with multimedia fanfare) could be made into the credit meter of the gaming machine G.

The controller 30 then enters stage 370 to deduct the bonus jackpot payout value from the bonus pool and to determine if the bonus pool is less than zero in the preferred embodiment. If it is, then stage 380 is entered ending the bonus mode and, if it is not, then stage 310 is re-entered to await the game end results for the next selected gaming machine S. The process then repeats itself until the bonus pool is depleted as detected by the controller 30 in stage 370 or until all selected gaming machines S have played. Under the teachings of the present invention, controller 30 selects the eligible gaming machine, makes the determination of bonus jackpot payoff values, and controls the additional bonus jackpot payoff by the winning selected gaming machine S.

In FIG. 1, and by means of illustration only, gaming machines G1 and G5 are shown, at a point in time, to be selected gaming machines (designated S1 and S2). The functional flow chart in FIG. 3, for this illustration, is performed for selected machines S1 and S2, and in stage 320 the game in each selected gaming machine S will end resulting in a losing combination or a winning combination in the slots 22. When a losing combination is obtained, stage 340 is entered and when a winning combination resulting in a payout at the machine is obtained, then stage 350 is entered. The functional flow chart in FIG. 3 is rapidly performed by the controller 30 for each selected gaming machine S. Even though a bonus jackpot payoff occurs which causes the bonus pool to go to zero or become negative thereby ending the bonus mode in stage 380, all remaining selected gaming machines S in play must finish. The controller 30 pays any resulting bonus jackpot payoffs which may drive the bonus pool even further negative in the same manner illustrated in stages 310, 320, 340, 350, and 360 repeat until the last selected game in progress is over. When the last game is over, the controller 30 announces that the bonus game is over in displays 70 and D.

In the course of awarding bonus jackpot payoffs, the controller 30 must track payments to correctly regulate the system 10. For each additional sum paid over the standard machine game payoff, this amount is subtracted from the bonus pool in stage 350. This process repeats until the bonus pool reaches zero or goes negative and all selected gaming machines S games have completed play and paid any bonus jackpot payoffs. Hence, several bonus jackpot payoffs may be paid even after the bonus pool drops below a predetermined low value such as zero. In all cases, the awards continue to be subtracted from the bonus pool, driving the pool even more negative. Therefore, while the depletion of the bonus pool triggers an end to the bonus mode, it does not necessarily reflect the total of bonus payments paid by the bonus mode. Only until after all selected gaming machines S that have been issued a bonus jackpot multiplier opportunity (i.e., a hot potato C) have reported back the outcomes of their respective conventional games does the controller 30 then know the true reset value of the bonus pool at the end of the bonus mode time period. Contributions again enter into the bonus pool from the full reset value and the bonus pool must grow large enough again to trigger the bonus pool for the next bonus mode time period.

The system 10 of the present invention can, in an alternate embodiment, operate without this condition, as the bonus mode can terminate using only fixed game counts. However, it is generally advantageous to use the depleted state of the bonus pool to terminate the bonus mode; this helps to create heightened opportunities and wider system dynamics.

The functional flow chart in FIG. 3 is implemented in the controller 30 and receives conventionally available information, such as the game end and the game payoff, if any, from the selected gaming machine S over the network 32. Further, the controller 30 delivers the bonus jackpot payoff information to the selected gaming machines. Any of a number of equivalent hardware and/or software designs and protocols could be utilized to implement the methods of FIG. 3 based upon the type of network 32 and controller 30.

3. System Expectation and Performance Stability

Regulating the system performance is a function of the bonus multiplier BM approach of the present invention. Prior bonus systems are regulated using two factors: time of play and depletion of the bonus pool. However, these forms of regulation do not necessarily yield stable and preferred system performance. The reason is that timed play cannot adequately compensate for variations in rate of play or number of eligible players. Using time as a regulation factor negates supporting the bonus multiplier approach of the present invention where the bonus multiplier BM preferably increases through successive bonus rounds BR. In such a time-regulated system, players can stall, and thus wait until bonus multipliers BM are at a higher level. A problem occurs when regulating using a fixed number of games per player, since when the number of eligible machines are small, the bonus multipliers BM will gravitate towards higher values more often, thus shifting the performance of the system with respect to performance with larger groups of players. Therefore, regulation by time alone, or by number of games per player is undesirable.

To solve this problem, the system 10 of the present invention first regulates the number of bonus opportunities group wide for each bonus multiplier BM offered. In this manner, time is not a factor, and system behavior can be controlled and adequately predicted regardless of the number of eligible machines or the speed of play at a machine. Equally significant, the system can be tailored to meet specific performance criteria by adjusting the number of bonus multiplier opportunities BO issued for each bonus round BR.

Furthermore, the rate of selecting gaming machines to participate in a bonus opportunity BO is another criteria allowing specific tailoring of performance criteria. Therefore, one unique advantage of the present invention is the random selection rate R of gaming machines E for bonus jackpot multiplier opportunities. In other words, the rate R at which BOs are issued from the fixed pool of BOs existing for a Bonus Round BR is controllable. It should be noted that the system 10 can operate without having depletion of the bonus pool in stage 370 being the only factor that terminates the bonus round. Issuing all BOs for each bonus round BR could also be an alternate terminating condition.

The primary factors required to adequately regulate the present invention are: (1) the number of bonus rounds BR; (2) the bonus multiplier BM used in each bonus round; (3) the number of games (i.e., bonus multiplier opportunities BO) to be played in each bonus round BR; and (4) the rate R at which bonus multiplier opportunities are issued (i.e., random selection rate).

In the preferred embodiment, the last bonus round BR normally supports an "infinite number" of bonus multiplier opportunities BO (i.e., hot potatoes) being issued. In this case, the depletion of the bonus pool is the only factor which terminates the bonus mode. In general, the values of the factors above are chosen by the operator through input 39 to controller 30 to optimize the system 10 for one or all of the following inter-related system attributes: (1) average duration of the bonus mode time period; (2) number of bonus rounds BR; (3) average expectation of entering each bonus round BR; (4) average number of game winners; and (5) average amount of bonus jackpot payoffs. It should be noted that the game par sheets for the games of the gaming machines G linked in the system 10 also contribute significantly to the performance and system expectations. Game par sheets are the conventional pay tables for each linked game and the associated hit frequency for each payout.

In yet another embodiment of the present invention, only a predetermined number of bonus multiplier opportunities BO are provided for the bonus mode time period. These opportunities are issued at a random selection rate to the eligible gaming machine which controls the average length of the bonus mode time period as discussed herein. In this embodiment there are not separate bonus rounds. Here the controller simply issues bonus multiplier opportunities until the bonus pool is depleted and the time period ends or until all bonus multiplier opportunities are issued. Multiplier values assigned to each bonus multiplier opportunity in this embodiment can be the same, or can increase if the opportunities are issued, or decreased, or randomly selected. In addition, the random selection rate R can also be constant throughout the time period, or can change so that eligible gaming machines are selected to receive opportunities faster, or slower, or randomly. Any number of a wide possible combination of effects can be achieved in this embodiment. For example in Table I below, 27 bonus multiplier opportunities are designed into the controller 10. For each bonus multiplier opportunity, a bonus multiplier BM is assigned as shown. And, for each bonus multiplier opportunity BO a rate R is assigned. Hence, in this example, a rising crescendo of excitement occurs as the bonus mode time period ends. The bonus opportunities carry much higher multipliers and they are much more frequently given as the end of the time period occurs.

TABLE I

| BO | BM | R |
|---|---|---|
| 1 | X2 | 1/10 |
| 2 | X2 | 1/10 |
| 3 | X2 | 1/10 |
| 12 | X5 | 1/5 |
| 13 | X5 | 1/5 |
| 14 | X5 | 1/5 |
| 25 | X10 | 1/2 |
| 26 | X20 | 1/2 |
| 27 | X30 | 1/2 |

4. Maximum Payment Cap Function

The system 10 of the present invention optionally supports a maximum capped payment function. This function dictates that bonus jackpot payoffs made to players are limited to a maximum amount. The possibility of hitting a large payoff in conventional play of the game multiplied by a large bonus multiplier BM creates a volatile jackpot bonus payoff situation thus depleting the bonus pool and driving it significantly negative. This possibility would also reduce the occurrence of bonus modes in the near future.

The maximum payout cap works as follows. For example, if the payout cap is set to $1000, then the maximum amount of money that can be contributed to the jackpot bonus by the controller is $1000. For example, a $100 standard game payoff resulting at game end in the underlying gaming machine during a 15 times bonus mode (BM=15×) results in a (15−1)×$1000=$1400 theoretical bonus jackpot payoff, but because of the cap, the bonus system will only pay $1000, thereby creating a total payment of $1100 to the player (i.e., $100 from the game payoff and $1000 from the bonus jackpot payoff). The bonus pool is debited $1000.

The cap can also be replaced by restricting the number of game payouts eligible to be multiplied, thereby controlling the same factor, but to a lessor degree, and with less player appeal. For example, if the following conventional game payoffs are: $5000, $500, $100, $10, $5, $2, and $1 for a predetermined set of winning combinations in the underlying gaming machine G, then bonus jackpot payoffs could be limited to only the lower valued game payoffs of $10, $5, $2 and $1. In the example of BM=15, then the maximum bonus payoff is (15−1)×$10=$140 so that the player receives $140 plus $10 for a total of $150.

5. Hidden Reserves

The provision of hidden reserves, or hidden reset amounts or hidden pools, is a conventional progressive function that can be optionally supported by the bonus system 10 of the present invention to help regulate the volatility of the bonus system, thereby minimizing the effect of large jackpots driving the bonus pool significantly negative.

6. Eligibility Functions

The system of the present invention preferably requires that players be eligible for the bonus mode time period. That is, players must have preferably played a predetermined amount of time before the bonus mode time period is triggered to be eligible for the bonus rounds BR. Player card activation may also be used as an additional eligibility requirement in which a player card must also be inserted into the gaming machine G. Maximum coin play may also be an eligibility option for the system of the present invention. If maximum coin eligibility is enabled, the player must play maximum coins to become eligible for the bonus mode. Both maximum coins and predetermined time intervals are conventional.

For example, and as illustrated in FIG. 4, a player is playing at one of the gaming machines G in FIG. 1. The controller 30 issues a bonus mode signal at time $T_{BM}$. The controller 30 obtains information for each gaming machine G in the system 10 to determine eligibility. FIG. 4 illustrates the situation where eligibility is determined based upon a player initiating play at gaming machine G in a predetermined amount of time after the prior game is over, having a player card inserted, and placing a maximum coin bet. It is to be expressly understood that all, any one, or any combination of these three or, any other eligibility requirement could be utilized under the teachings of the present invention.

In FIG. 4, as shown by timeline 400, a player completed play of a conventional game in a gaming machine at time $T_{GO}$ and started the next game at time $T_{GS}$. To be eligible, the starting of the next game at time $T_{GS}$ must be within a predetermined time period, $\Delta T_P$, after time $T_{GO}$. In other words, the player to "maintain" eligibility, must start the next game within a predetermined time after finishing the prior game. To be eligible for bonuses during bonus mode BM, the player must "be" eligible at the time the bonus mode starts $T_{BM}$. The determination of eligibility based upon the player having played a predetermined amount of time before the bonus mode is triggered at time $T_{BM}$ can be determined in the interface card 34 in the gaming machine G or with the controller 30 making determinations by receiving the GO (i.e., game over) and GS (i.e., game start) signals from the gaming machine G over network 32. In the preferred embodiment, this occurs in the interface card 34 and this determination is conventional. A timer or a countdown counter can be conventionally utilized, for example, to start $\Delta T_P$ with $T_{GO}$ and to sense $T_{GS}$. If $T_{GS}$ is not sensed during $\Delta T_P$, then the controller detects an ineligible signal from the interface.

In another variation, controller 30 could determine whether or not a player card is inserted into the gaming machine G which occupies timeline 410 in FIG. 4. This is a conventional signal coming from the gaming machine G or interface card. In an alternate embodiment, when the player card is first inserted, the controller 30 receives this information over the system bus 32 and, hence, at time $T_{BM}$ if it has not received a player card remove signal from the gaming machine, the controller 30 knows that the player card is still inserted at time $T_{BM}$.

Finally, if at time $T_{GS}$, the player has made a maximum bet, this information is also conventionally available as shown by timeline 420 either from the gaming machine itself or from information delivered earlier to the controller from the gaming machine G. Should the bonus mode occur between $T_{GO}$ and $T_{GS}$ for a particular gaming machine, then the maximum bet information from the prior game is utilized. Furthermore, the gaming machine is eligible even though the game start signal $T_{GS}$ has not occurred yet. When primary eligibility is determined at time $T_{BM}$, the displays D at eligible gaming machines E show hands up as shown in FIG. 2(*c*) by graphics 20*b* ready to grab a hot potato C. If not eligible, the hands are down 20*a* in FIG. 2(*b*).

Any eligibility requirement can be utilized under the teachings of the present invention.

In addition to the primary eligibility requirement above, the system 10 can support an optional secondary eligibility function. In FIG. 5, for a particular eligible gaming machine E, in order to maintain secondary eligibility during the bonus mode time period, the player must start each game within a $\Delta T_S$ time frame. As illustrated in FIG. 5, the player is shown to lose eligibility since the next game is commenced ($T_{GS}$) outside of the predetermined time, $\Delta T_S$. Hence, at time $T_{NE}$, the player is no longer eligible to participate in the current bonus round of the bonus mode and hands 90 are shown down 20*a*. In a variation, if the player continues to play and all future plays are within the $\Delta T_S$ frame, then the player can regain eligibility at the start of the next bonus round BR. Again, secondary eligibility can also be based upon whether the player card is still inserted, whether a maximum bet has been placed, or any combination thereof. In some variations based upon the teachings of the present invention, secondary eligibility can also be the placing of a separate bonus round wager. That is, once in bonus mode, eligible players must place a separate wager (or an increased wager) to play in order to receive a chance for a bonus multiplier. This is represented in the hot potato bonus theme as hands being "held up" (FIG. 2(*c*)) when the player plays . . . meaning the player is ready to catch a potato C, at which time in this embodiment, a separate wager is placed.

7. Bonus Mode Time Period Operation

The bonus jackpot system 10 of the present invention provides a high degree of fanfare in its multimedia presentation system 40 to attract onlookers and spectators to the system. In particular, the system uses a specially lighted lamp L on each gaming machine G to indicate to spectators that a particular bonus multiplier BM is active for that game. Generally, the lighted display lamp L is on top of the gaming machine G, and is viewable from all angles for maximum effect. Furthermore, the lamp L is controlled in such a fashion as to create a travelling motion similar to a musical chairs effect across all machines. In another embodiment, the traveling motion occurs only on the lamps of the eligible players. As in musical chairs, the lights 50 will suddenly stop at the selected eligible gaming machines S, as players at those eligible machines E will receive bonus multipliers BM for any payout upon completion of a game. Two basic options under the teachings herein are: (a) rotate the lamps during bonus mode and freeze ON a lamp when selected, or (b) rotate lamps in transition mode and freeze lamp ON in the bonus mode when selected.

Figure 6:
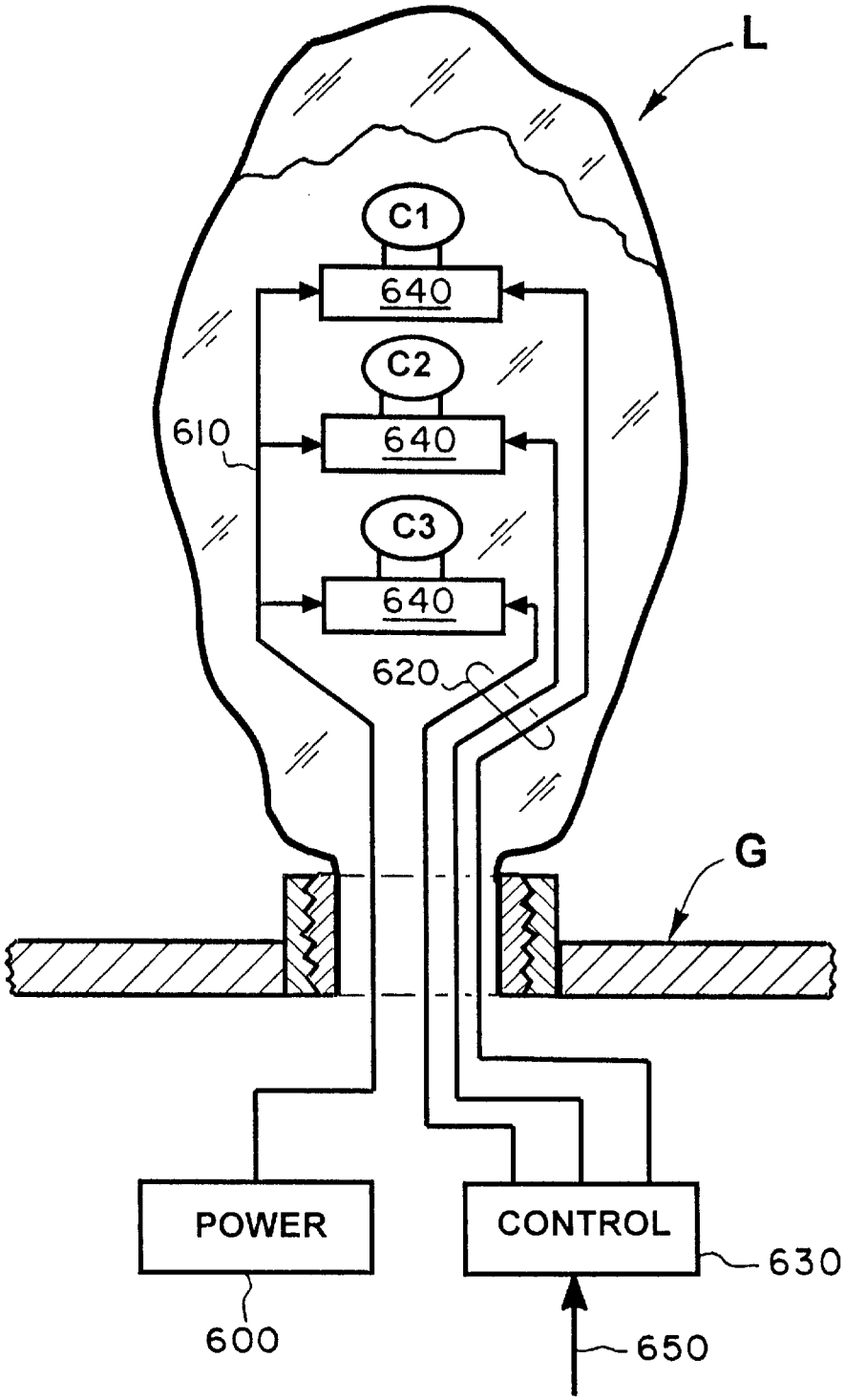
FIG. 6 sets forth the details of the tower lamp on each gaming machine of the present invention.

The specially lighted lamps L preferably contain three bonus lights of different color. In FIG. 6, each light L is in the shape of a potato in the preferred embodiment of the game. Any suitable shape for the lamp can be utilized. Disposed on the interior of the lamp L are three lights C1, C2, and C3 which can be any suitable color such as yellow, red, and blue. Each lamp L could also have panels, not shown, showing 2×, 3×, 5× positioned over the lights C1, C2, and C3 respectively. Each lamp L has power 600 delivered to it over lines 610. Whether or not power 600 is delivered to a light C1, C2, or C3 depends upon control signals delivered over lines 620 from a control circuit 630. At each light C1, C2, and C3, exists a solid state relay 640. In the presence of a suitable signal on line 620, any one of the lights C1, C2, or C3 or any combination thereof can be selectively lit through activation of the solid state relay 640. It is to be expressly understood that many conventionally available lighting and lighting control systems responsive to digital commands delivered from controller 30 such as those delivered over line 650 could be utilized under the teachings of the present invention. These lights correspond to bonus multipliers BM, such as C1=2×, C2=3× and C3=5×. For example, when BM=2, the 2× light, C1, will be lit. Likewise, for BM=3 and BM=5 jackpot modes, the 3×-bonus light, C2, and the 5×-bonus light, C3 will be lit respectively. Higher bonus multiplier modes will be offered also, and can be represented by combinations of lit bonus lamps. For example, the BM=10 multiplier mode is represented by turning on both the 2× and 5× pay lamps C1 and C3. Likewise, the BM=15 and BM=30 multiplier modes are represented by turning on the correct number of multipliers to equal these values.

Figure 7:
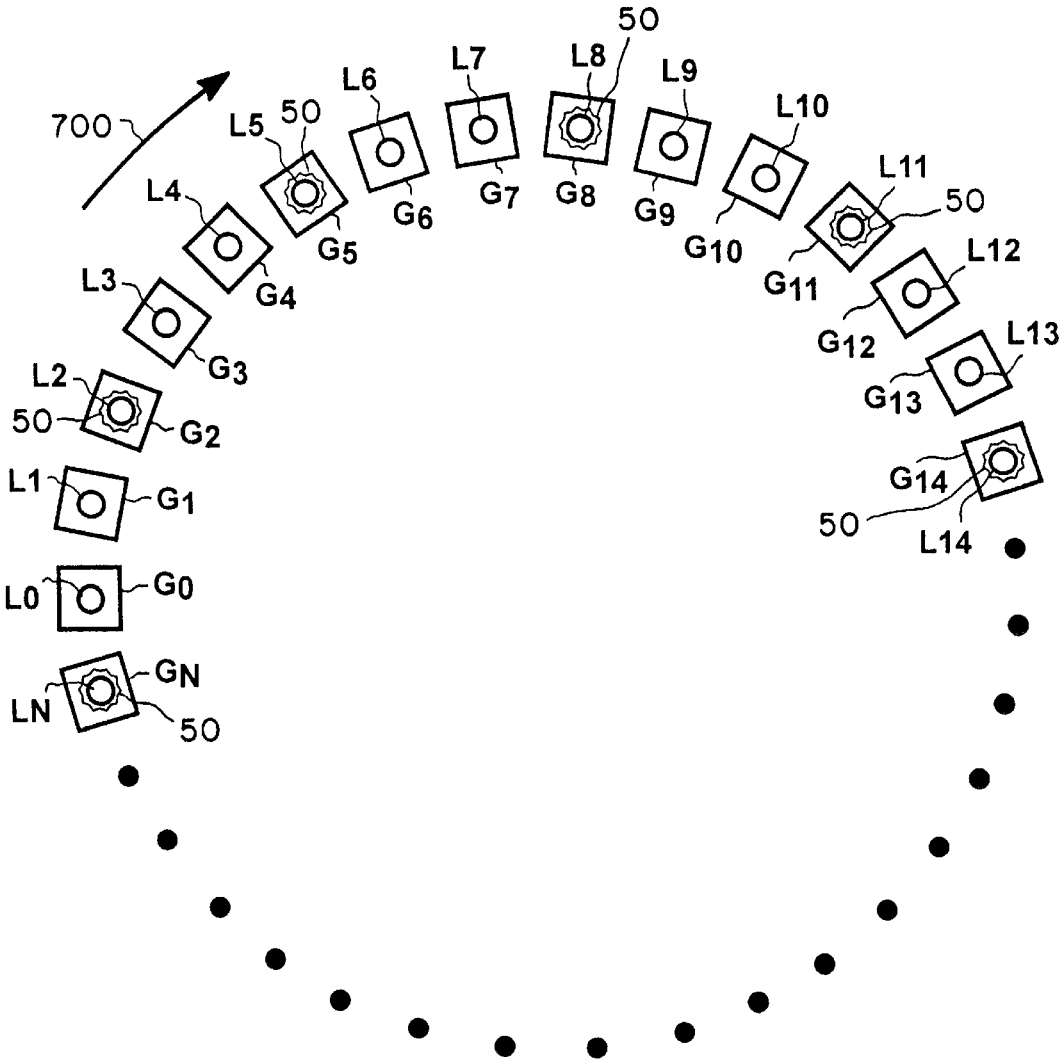
FIG. 7 sets forth an illustration of the lighting of the tower lamp of the present invention.

The bonus controller 30 is in charge of rotating the multiplier lamps L across all machines as shown in FIG. 7 in an attract mode. In general, this effect is created by walking a lamp L through three positions (two positions will not adequately show movement). Therefore, the controller 30 must properly initialize a string of bits that represent the lamps that are on. In a string of N bits, where N represents the total number of machines G linked 32, the bonus controller 30 will turn the light C1 in every third lamp L on. The bits in the array will represent the state of the tower lamp L and are shifted by one position in rapid succession. This action will cause the tower lamps to appear to walk across machines and create the intended effect. In this description, the lights are preferably always spaced by one-third. In FIG. 7, a number of gaming machines G are arranged in the carousel. The gaming machines are labeled G0, G1 - - - GN. On top of each gaming machine, as shown in FIG. 1, and in FIG. 6, is a lamp L. The lamps are labeled L0, L1, L2 - - - LN. The effect achieved, as described above, causes the lamps to appear to move in the direction of arrow 700. Hence, if in the bonus mode time period, the bonus multiplier, BN, is 2×, then light C1 is lit on every third lamp. The lit lamp is shown as 50 in FIG. 7. Hence, it can be easily determined by players and viewers what the bonus multiplier, BM, is since the appropriate color C1, C2 and/or C3 is lit. However, any suitable lighting effect can be achieved other than that just described.

The fanfare announces a bonus mode for which jackpot bonus multipliers, BM, are illustrated moving around the carousel; it is referred to in the preferred embodiment as the hot potato exchange. In this mode, the currently active bonus multiplier is available to lucky randomly selected gaming machines S. In this mode, the controller chooses eligible players for a chance to win multiplied jackpots. This is accomplished by monitoring all game start GS signals in real time, and performing a random function to determine if that eligible machine E will receive the current multiplier. If so chosen, the controller must deliver a message to the game display in real time to inform the eligible machine that it has "caught" a bonus multiplier as shown in FIG. 2(*d*).

The synchronization of the tower lamps L is as follows. As stated before, the tower lamps will appear to walk across the carousel in a musical chairs style as shown in FIG. 7. When the controller 30 determines that selected gaming machines S receive a bonus multiplier, the tower lamps L light the appropriate color for the bonus multiplier BM over the selected gaming machines. These tower lamps L appear to be singled out from the overall synchronization of the carousel. The lamp can still walk with the other lamps by changing to a third color, or optionally will stay steady lit with the specific bonus multiplier color.

8. Game Display Operation

In contrast to the operation of the tower lamps L, each gaming machine G, as shown in FIG. 1, has a display D, and a speaker 24, and the bonus controller 30 will coordinate its operation as follows.

There are several different operating modes for the display D depending on the bonus mode and other modes of operation of the carousel and/or specific gaming machine outcome. These modes are outlined below for the three basic modes of system operation with multimedia presentations in displays D and speakers 24 (similar multimedia presentations occur in display 70 and speaker 60):

NOT in bonus mode and NOT in attract mode:

1. Player Not Eligible display—FIG. 2(*a*) text 200 such as "not eligible"
2. Player Eligible display—FIG. 2(*a*) text 200 such as "eligible"

In attract mode and NOT in bonus mode:

1. Player NOT eligible and showing an attract presentation—FIG. 2(*a*)
2. Player eligible and showing an attract presentation—FIG. 2(*a*)

In bonus mode:

1. Player NOT eligible display 20*a*—FIG. 2(*b*)
2. Player eligible display 20*b*—FIG. 2(*c*)
3. Player eligible and chosen for multiplier display 20*c*—FIG. 2(*d*)—(shows bonus round multiplier)
4. Player chosen for multiplier but loses underlying game—(either shows bonus round multiplier or generic display)
5. Player eligible for multiplier and wins—(shows bonus multiplier and celebrates win)
6. Bonus Round transition sequence—(shows new bonus round or generic display)

The above outlined display modes for displays D are preferred and show moving graphics combined with adequate text and/or sound in speaker 24 to illustrate the corresponding mode. These graphics will also be combined with sound at each gaming machine. Each mode above will be described in more detail using the potato graphics as an example.

(i) NOT in Bonus Mode

When the system 10 is not in the bonus mode time period, a gaming machine G can be played, or it can be idle. If the gaming machine G is idle, the display D shows a theme graphic that advertises the game. If the gaming machine G is being played, then the display D shows that player is eligible or ineligible via the text 200.

At predetermined or random intervals, the system 10 enters a special attract sequence that causes the in-machine display D to play graphics and sounds that advertise and explain the bonus game. In this mode, it is also required to overlay the eligibility message if the game is being played while also in attract mode.

The overhead display 70 and sound system 60 provide complimentary presentations to the game display.

(ii) In Bonus Mode

Showing Eligibility: When the bonus mode time period starts at time $T_{BM}$, only eligible gaming machines E may participate as shown in FIG. 4. This is clearly shown at the beginning of the bonus mode by a special set of graphics depicting "hands" 20*b* that are open and ready to catch a hot potato C as shown in FIG. 2(*c*). If the screen contains a set of open hands, that gaming machine G is eligible E. If the gaming machine is not eligible, then graphic 20*a* (hands down) is displayed indicating that the gaming machine is not eligible during the bonus round.

A graphical ingredient of the bonus system is hands being idle or down 20*a* in FIG. 2(*b*) when the machine is not eligible. Eligible machines E have hands raised 20*b* upward in anticipation of catching a hot potato C, as shown in FIG. 2(*c*). If selected by the controller 30 to receive a bonus multiplier opportunity, the player will the catch 20*c* the hot potato C before their game finishes (FIG. 2(*d*)).

Another feature of the system is triggering a recorded voice message to play in speaker 24 when a player initially becomes eligible. In other words, once a machine that has not been played for a predetermined amount of time is played, a voice will trigger stating "you're now eligible for hot potato!". If the player continues to play and be eligible, the sound is not re-triggered. The sound or voice is only triggered once the eligibility is initially activated.

Catching a Potato: If the eligible gaming machine E is selected S for a hot potato 20, the display D at that gaming machine G will trigger a "hot potato catch" graphics sequence 20*c*, FIG. 2(*d*), just after the game is started $T_{GS}$. The graphics sequence and accompanying sound in speaker 24 will tell the player that a multiplier has been caught, and that the pending game is entitled to multiplied payouts. The graphics sequence for the hot potato catch will also show the appropriate round level showing the present multiplier that is active. For example, if the present bonus round is two times pay, the selected machine S catching a potato C might see an animated potato with a 2× sign 210 (FIG. 2(*d*)) bounce into their hands, with the sound track playing in speaker 24, "oooh! I caught a two timing potato!".

Losing with a Potato: Once a player has caught a potato, whether they win a bonus jackpot or not will depend on the outcome of the underlying game. If the player does not win anything on the game, then a loser sequence is shown on the display D. The loser sequence, in the preferred embodiment, will typically show the hot potato flying out of the player's animated hands, not shown. There are different flying away graphics sequences for each available bonus round BR in general. Once the loser graphics have finished, the display D will show the player's hands in the open position 20*b* of FIG. 2(*c*) ready for the next opportunity.

Winning with a Potato: If a player has caught a hot potato C and wins a payout on that game, a winner sequence is played at the in-machine display D. The winner sequence, in the preferred embodiment, shows an animation of the hot potato character getting hotter and hotter as the bonus award is paid to the player's credit meter or hopper. The graphics may also show the bonus credits accumulating with an animated "over sized" credit meter. For each bonus round BR available, a different winning sequence is displayed. For example, if a player wins a five time bonus pay, the display D, in the preferred embodiment, shows a five times animated potato jumping about while the sound in speaker 24 plays "You're a big five times winner . . . beats being a five times loser!". Just prior to the game paying out all bonus credits, the display D will trigger the potato flying out of the hands, as the player's hands now prepare to catch a potato C in the next game.

Bonus Round Transition Sequence: The bonus game of the present invention is dependent on a fixed number of bonus multiplier opportunities BO (i.e., potatoes) being awarded for each multiplier round BR. The fixed number of bonus rounds BR offered within the bonus mode time period depends on individual game outcome and overall bonus pool solvency. For the player, the entry into another bonus mode round means continued bonus multiplier opportunities, and is therefore treated with a high degree of fanfare in the displays D.

For the in-machine display D, the bonus mode transition graphic shows all the possible bonus rounds representing all available bonus round multipliers. The graphic will typically show each bonus multiplier flash in sequence, suggesting that any of the bonus rounds could be made available. Towards the end of this fanfare, the graphic clearly shows the resulting selection and the new round multiplier that will be offered. As a technical note, the bonus transition fanfare can be the same used for each round, as the starting (eligibility) graphic of the next round also shows the resulting bonus round and new multiplier.

FIG. 2 illustrates only one of many possible graphical presentations for informing players of eligibility and then being randomly selected for receiving a bonus opportunity. Potatoes are used to illustrate the invention, not to limit its scope.

9. System Stability

The bonus system 10 of the present invention is regulated, stable, and creates a fair bonus opportunity for all eligible players. The system 10 does not create unequal advantages to players when the number of eligible gaming machines E changes. For example, the system 10 should not significantly increase the chances of hitting a large jackpot if the number of eligible gaming machines E is small. Furthermore, team players can defeat a poorly engineered bonus system if it is possible to force the game multiplier by waiting or otherwise defeating the system. Therefore, to solve this vulnerability, the system of the present invention ensures a regulated and preselected set number of bonus multiplier opportunities BO (in the example, potatoes C) are issued in each bonus round BR at a rate R, regardless of the number of eligible gaming machines E.

Optionally, the number of games (i.e., bonus multiplier opportunities BO) in each bonus round BR of the system 10 of the present invention does not have to remain absolutely fixed, and can be randomly chosen within a predetermined range of numbers, but the range of the number of games played should be fixed. This adds further unpredictability to the game.

In this manner, regardless of the number of eligible gaming machines E, a regulated number of bonus multiplier opportunities BO is issued by the system 10 at a rate R before the next bonus round BR and a new bonus multiplier BM is selected. In addition, once the bonus pool drops below zero, the controller 30 will terminate the bonus mode period immediately, as no other eligible gaming machines E will be selected to play game multiplier opportunities. (As explained above, all games catching potatoes, i.e., received bonus multiplier opportunities BO, are allowed to complete and all jackpot bonuses are paid.)

Because the system 10 regulates and fixes the total number of bonus multiplier opportunities BO issued for each bonus round BR, an essential adjustment variable is created which allows the system to be "tuned" for maximum player appeal. This adjustment is made using the set-up parameters shown on the example set-up screen in FIG. 8 at controller 30. The user of controller 30 pre-configures the number of bonus multiplier opportunities BO for each bonus round BR. This serves to regulate the average value of bonus jackpot payoffs and how many times (on average) the system 10 will reach each bonus round BR within a given bonus mode time period. Using this set-up capability, the controller 30 can be adjusted and optimized to affect average bonus jackpot payoff amount, length of bonus play, and frequency and chance of entering each bonus round BR. Thus, the present invention creates significant control parameters over the classical prior art bonus systems supporting little or no control parameters affecting system game behavior, performance, and expectation.

Figure 8:
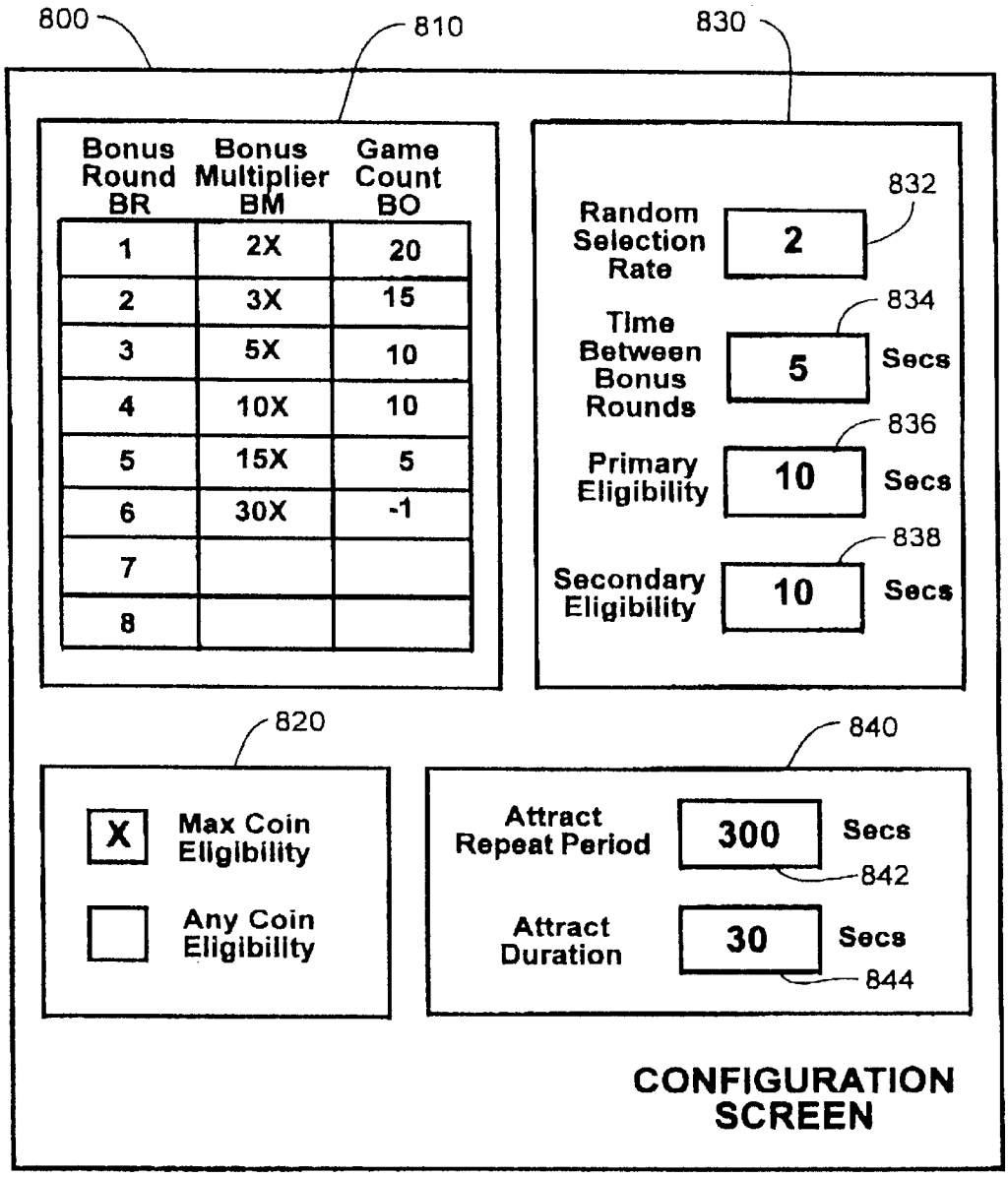
FIG. 8 sets forth the configuration screen of the present invention.

In FIG. 8, the configuration screen 800, which comes up on a monitor 38 associated with controller 30 of FIG. 1, allows the user through a suitable input device 39 (e.g., a keyboard, mouse, etc.) of the controller 30 to configure a bonus game according to the teachings of the present invention. In window 810 of screen 800, the user can configure and predetermine the values of the bonus multiplier BR, the bonus multiplier opportunities (i.e., Game Count) BO, and the number of bonus rounds BR. The "game count" is the predetermined number of bonus multiplier opportunities BO to be issued in a particular bonus round BR. In FIG. 8, for example, eight possible bonus rounds BR are provided, but only six are used. For the 2× bonus round (i.e., BR=1), 20 game bonus opportunities of 2× are made (i.e., BM=2×, BO=20). For the fifth bonus round (i.e., BR=5) of 15×, five bonus multiplier opportunities are configured (i.e., BM=15×, BO=5). These are actually bonus opportunities BO, since the outcome of the game may not result in a game payout. In which case no bonus jackpot payoff is made, but one of the "bonus opportunities" is used up. As mentioned in one variation of the present invention, the value of BO may be randomly selected in a range of numbers. For example, for BM=2×, a range could be 18–22 bonus opportunities BO and a number from the set of {18, 19, 20, 21, 22} would be randomly selected at the start of the bonus round BR.

To add more excitement and also under the teachings of the present invention, it is to be understood that the use of a range could also be made for the actual number of bonus rounds BR and the actual value of the bonus multiplier BM. For example, at the start of each bonus mode time period a range of bonus rounds BR could be randomly selected such as in the range of 4 through 8 bonus rounds. Hence, the number of bonus rounds BR could be selected from the set of {4, 5, 6, 7, and 8}. In which case, the field 810 would be completely filled out of all bonus rounds. In yet another embodiment, the bonus multiplier for a given round could be selected randomly in a range. For example, in bonus round BR=1, the bonus multiplier could be selected in the range of {2×, 3×, 4×} at the start of each bonus round. A number of various equivalent approaches could be taken from the teachings of the present invention to add randomness and excitement to the game.

Furthermore, the user can select how many of the bonus multipliers BM should be used. For example, the user may only design in three bonus multipliers BM of 2×, 3×, and 5×. It is to be expressly understood that what the bonus multipliers BM are and how many "bonus opportunities" BO for each bonus multiplier in each given bonus round BR is and, in truth, how many bonus rounds BR there are can be selected by the user of the controller 30 by suitably entering data into window 810 of the configuration screen 800. In window 820, the user can select a primary eligibility requirement based upon "max coin" or "any coin" in. It is to be expressly understood that eligibility could be on any desired combination of coins in or wagering. A similar window to window 820 could base eligibility on the presence of a player card inserted into the gaming machine, as previously discussed.

The values for the factors of: the range of the bonus pool, the number of bonus rounds BR, the bonus multipliers BM, and the bonus opportunities BO configured into the controller 30 by the operator allows the operator to tailor the bonus game to the financial and performance expectations of the casino based upon the house advantages and payoff tables in the underlying game of the gaming machine. Furthermore, the operator can control the duration of the bonus mode time period by selecting a larger number of bonus rounds, lower multiplier values in the early bonus rounds, and how many bonus opportunities are to be issued. Clearly, in the extreme, if two bonus rounds are provided with the first bonus round having bonus multiples BM of 15× and the second bonus round having bonus multiples BM of 30×, and with bonus multiplier opportunities BO for each bonus round being 20, the bonus mode time period, on average, will be very quick and, in most cases, would represent an undesirable bonus game for the operator. In addition, the selection of these values by the operator can allow the operator to tailor the game to meet the expectations for the theme of the game such as a rising crescendo towards the end of the bonus game to add excitement for the player. The use of a "hot potato" herein is one such example. Here the operator can provide a number of separate bonus rounds with ever increasing values for the bonus multipliers as each new successive bonus round is entered and with fewer bonus opportunities being issued by the system in number. Hence, not only is the average bonus mode time period duration controlled or regulated by proper selection of these values, but also regulation and control over player expectation and excitement based upon an overall theme. In addition to setting these factors, the rate R that the bonus opportunities BO are issued is also a factor in controlling the average duration of the bonus mode time period which will be discussed next.

In window 830, other configuration data is provided. In area 832 the random selection rate R (i.e., in the example, the average number of "games between potatoes") is configured. The number "2" shown means to select one out of two eligible gaming machines on average. Selection occurs in real time as the controller detects game start signals from eligible games whether a particular game start signal results in a selected game S determined by the result of the random f(x). This function enables the operator to control the length of the bonus time period.

In area 834, the time between the bonus rounds BR is shown to be, for example, five seconds. Hence, between the 2×-bonus multiplier round and the 3×-bonus multiplier round five seconds would occur. This, of course, can be any suitable time interval so that, for example, a multimedia fanfare presentation can be made. Again, this affects the average duration of the bonus mode time period and allows suitable time for bonus mode transition fanfare.

In area 836 the user sets the primary eligibility time, $\Delta T_P$, shown in FIG. 4, to be ten seconds and in area 838 sets the secondary eligibility time $\Delta T_S$, as shown in FIG. 5, to be also ten seconds. Any suitable time can be set for the time in these two areas, 836 and 838, and, of course, the times do not have to be equal.

Finally, in the attract window 840, the attract repeat period in area 842 is set for 300 seconds (or five minutes) and the attract duration is set for thirty seconds in area 844 (or half a minute). Again, the attract presentations can be of any suitable repeat period and of any suitable duration.

In the sample configuration screen 800 of FIG. 8, the system configuration parameters are shown. In the upper left window 810, the game count and the associated bonus multipliers are listed. This configuration table allows the system 10 to control how many bonus multiplier opportunities there are for each particular bonus round. Note that there are six possible bonus rounds being configured in this example (i.e., 2×, 3×, 5×, 10×, 15×, and 30×). The "−1" in the last 30× bonus round indicates that the system 10 will continue to issue bonus multiplier opportunities BO (i.e., potatoes) until the bonus pool is depleted thereby ending the bonus mode time period. The configuration screen 800 is only an illustration and it is to be expressly understood that many equivalent input formats and designs could be utilized under the teachings of the present invention.

10. Controlling the Average Duration of the Bonus Mode Time Period

In prior art systems of this type (e.g., double jackpot time), it is accepted that once double jackpot time is triggered, all eligible players play for double jackpots. For system bonuses that double (or otherwise multiply) all gaming machine G payouts, the ability of the system to sustain length of time in the bonus mode time period is severely limited due to financial solvency. Therefore, such a short bonus mode time period eliminates time for which to attract onlookers, and for which to raise player expectations and awareness. The present invention solves this classic problem by creating a scenario for which a fraction of the number of eligible players are playing for multiplied bonus jackpot payouts at any given time, and also creates a scenario for which players expectations will be heightened due to an ever increasing bonus multiplier offering during successive bonus rounds.

The system 10 of the present invention capitalizes on having a portion of eligible players play for each multiplier value at any moment. This helps achieve several objectives. First, it creates a mechanism to limit the maximum payback rate in each bonus mode. With traditional double jackpot time systems, when all machines are played, the payback rate is maximized, and hence the bonus mode will be shortest. In this invention, the payback rate is better regulated, since only a percentage portion, or a fixed number portion, of eligible players will play for multiplied jackpots in each bonus round (i.e., will be selected S). This decreases the payback rate and extends the bonus mode time period, even if all machines are eligible.

The bonus controller 30 accomplishes the selection S of a portion of eligible gaming machines E for reception of a bonus multiplier opportunity BO (i.e., a hot potato) by maintaining a random function selector and by testing each game start $T_{GS}$ signal in real time from each eligible gaming machine S. In other words, as game start $T_{GS}$ signals from the eligible gaming machines E are detected by the controller 30 (which are conventionally generated in the gaming machine), each instance is tested by the controller 30 using a preconfigured random selector. The random selector outcome is either "yes" or "no". If yes, the gaming machine is selected S and receives a bonus multiplier opportunity BO (i.e., potato C).

The random selector may be a statically weighted function, such as 1 chance out of a set number of game starts (2, 3, or 4, etc.) on average, or may be dynamically weighted, and depend on the number of eligible players (N), such as 1 chance out of N starts on average. For dynamically weighted random selectors, N is typically based on the actual number of eligible gaming machines E. Note that bonus multiplier opportunities BO are awarded by controller 30 in a well-regulated and controlled fashion and can be terminated in a synchronous manner, unlike that of traditional systems. Secondly, the existence of limiting bonus jackpot opportunities BO, and controlling the rate R at which they are issued to all available eligible gaming machines E creates essential variables needed to extend the bonus mode time period in a flexible manner. The random selection rate R(X) (i.e., where X is either static or dynamic) allows the operator of the system 10, through input 39 to controller 30, to fully regulate the average duration of the bonus mode time period. On average, 1 out of X game starts are selected. For example and to illustrate the extremes where X is static, assume X=2, then every other game start by an eligible gaming machine in the bonus mode time period is selected to receive a bonus multiplier opportunity on average. Assume X=10, then every tenth game start by an eligible gaming machine in the bonus mode time period is selected on average.

In another preferred embodiment, the selection is a function of both the number of eligible gaming machines, E, and the rate R of selection. Here, on average 1/(E×R) game starts are selected. For example, with 20 eligible gaming machines (i.e., E=20) and with R=2, then selection, on average, occurs 1/(20×2)=1/40 times (i.e., one out of every 40 game starts on average).

Hence, the operator has actual control over the average duration of the bonus mode time period without affecting the financial expectations by the operator of the bonus game. Clearly any eligible gaming machine winning a large jackpot payoff in the underlying game and receiving a multiple may suddenly cause the bonus mode time period to end. However, the operator, as discussed above can control the frequency of the rate R by suitable selection of the value of X.

As a variation to this embodiment of the present invention, the following table may be a window in screen 800 of FIG. 8. In other words the following table substitutes for field 832.

TABLE II

| Bonus Round | R(X) |
|---|---|
| BR1 | 2 |
| BR2 | 2 |
| BR3 | 2 |
| BR4 | 3 |
| BR5 | 4 |
| BR6 | 5 |

In Table II above, the static value of X controls the rate of random selection of BO. Hence the rate R(2) in bonus rounds BR1 and BR2 as shown in the table above is much faster than the rate R(5) for bonus round BR6. In play of this version of the bonus game of the present invention, the eligible machines in bonus round 1 are much more frequently selected to receive bonus multiplier opportunities when bonus multipliers are of low value. Hence, this round goes by quickly. However as the play proceeds to the last bonus round, bonus round BR6, the rate R of random selection goes down so that in bonus round 6 every fifth eligible machine is selected, on average, but the bonus multiplier opportunity corresponding to a bonus multiplier is much higher. Hence, the players are feverishly playing to receive a high multiple such as 30× in FIG. 8.

Therefore, it is possible to regulate the average length of the bonus mode time period without altering the financial expectations for the system by the selection step of the present invention.

The above discussed steps of random selection occurring statically or dynamically are preferred. It is to be expressly understood that any method for randomly selecting a portion of the eligible gaming machines (whether based upon primary or secondary eligibility) is equivalent.

In the upper right window 830 of FIG. 8, the random selection rate allows the random game selector rate R to be configured. In this case, the setting 832 of "R=2" indicates there is a 1 in 2 chance (on average) of any game start, $T_{GS}$, being chosen to receive a bonus jackpot multiplier opportunity. It is to be expressly understood that while the controller 30 (through the network 32 and the interface 34) uses the conventional $T_{GS}$ signal that any suitable signal or condition indicating game start could also be used. In some embodiments, under the teachings of the present invention, conventional signals for the underlying gaming machine G could also be utilized such as game play or game end. For example, the end of game signal could be utilized at which time the player would see in his or her gaming machine G in display D an immediate graphical scene of an issued bonus multiplier opportunity BO (i.e., a hot potato) at game end. In a preferred embodiment, of course, it is preferred to use a start of game signal $T_{GS}$ so that the player can have added excitement knowing that while he or she is playing the game in the underlying gaming machine G the payoff may be multiple.

Other parameters in the system discussed above allow other variables to be adjusted, such as the time 834 between bonus rounds (transition timing) as well as other optional configuration parameters such as eligibility timing 836 and 838, maximum coin eligibility option (not shown), and attract mode timing 840.

11. Coin Play Eligibility Details

The system may operate as a "max" coin play only bonus, or alternatively, as "any" coin play bonus system. The following describes both modes.

In "max" coin play mode, players must play max coin in order to qualify for the bonus mode time period. In some jurisdictions, regulators can mandate that the bonus pool is contributed by max coin wagers only when operating in this mode.

In "any" coin mode, the system 10 allows eligibility based upon any numbers of coins played, but must protect against players that bet low during idle mode then bet high when in bonus mode. This is optionally solved by locking in the wager size at eligibility time. That is, if players are playing one coin before the bonus mode triggers, then they are entitled to double jackpots of one coin value. For example, if a particular reel combination pays 2 coins for one coin wagered, and pays 4 coins and 6 coins when 2 coins and 3 coins are wagered respectively, then this machine is referred to as a coin multiplier. If a player is eligible for a single coin, and they wager and win on a double jackpot, then their prize will double the payout for the single coin plus the standard amount of payout due for coins two and three. Therefore, the system only multiplies payouts up to the multiplier level the player becomes locked in at.

As an alternative to the complex coin eligibility lock in procedure given above, the alternate form of any coin eligibility ignores players who wish to contribute a low wager when not in bonus mode, but switch to a higher wager during bonus mode.

12. Bonus Mode Time Period Operations

Figure 9:
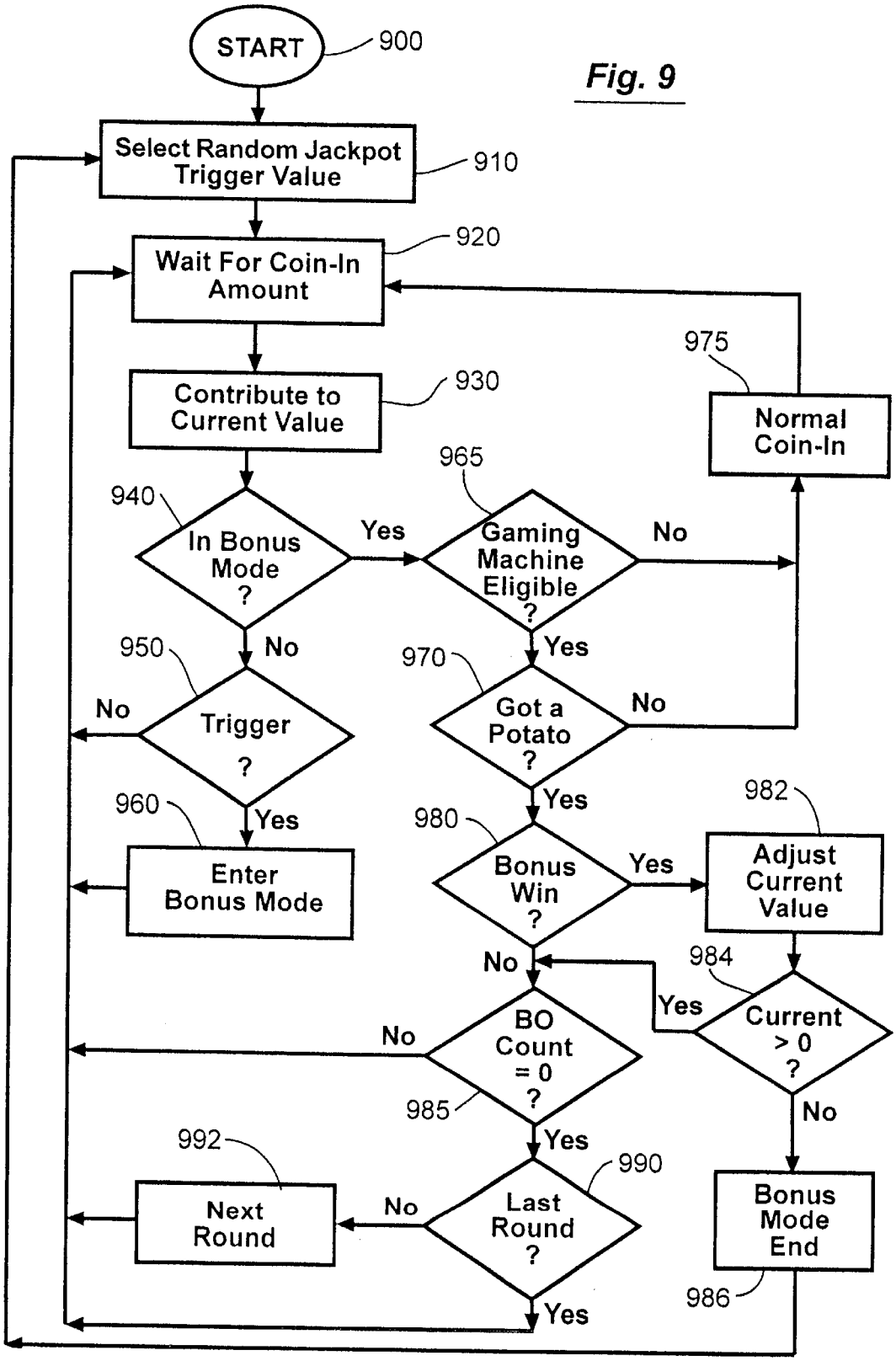
FIG. 9 is a functional flow chart showing the operation of the bonus mode.

In FIG. 9, the functional operation of the controller-based linked gaming machine bonus system 10 of the present invention is shown. In stage 900, the controller 30 starts through initialization. In stage 910, a random jackpot trigger value is selected by the controller 30. This value, as discussed, is selected between an upper value and a lower value. Hence, for each new bonus game (i.e., bonus mode), a new jackpot trigger value is randomly selected between these two values. The initial current value for the bonus pool is set to a base value which can be any suitable starting amount. Controller 30 then monitors for coin in information from each of the gaming machines G in FIG. 1 via the conventionally understood function of polling each game, not shown. Information is delivered over bus 32 in a conventional fashion. This occurs in stage 920. In the preferred embodiment, the controller 30 sequentially interrogates each gaming machine G by communicating to the interface card 34 in each gaming machine G. If there is any data to be communicated from the gaming machine G to the controller 30, this data is delivered during a sequential access in the preferred embodiment. Hence, when coin in information occurs at a gaming machine G, in stage 920 that coin in information is received by the controller 30 and in stage 930 a percentage of the coin in amount inserted by a player is contributed to the current value. In stage 940, a determination is made as to whether or not the system 10 of the present invention is already in the bonus mode. If not, then stage 950 is entered which compares the current value to the randomly selected jackpot trigger value and, if it equals or exceeds the trigger value, then stage 960 is entered causing the system to go into the bonus mode (i.e., time $T_{BM}$). If not, stage 920 is re-entered and the system processes the next coin in amount from the next sequentially accessed gaming machine G. System 10 of the present invention continues this process until the bonus mode is entered in stage 960. In other words, players at the gaming machines G play the games in the gaming machines G conventionally until the current value equals or exceeds the randomly selected jackpot trigger value. It is to be expressly understood that stages 910, 920, 930, 940, 950, and 960 are conventional and exist, for example, in the MONEYTIME game.

When the system enters the bonus mode at time $T_{BM}$, then the system 10 moves from stage 940 into stage 965 to determine whether the coin in received is from an eligible gaming machine E. To be eligible, the gaming machine must meet the requirements such as shown in FIG. 4 and discussed in association with FIG. 4. If the gaming machine is not eligible, then stage 920 is re-entered through normal coin in stage 975. In other words, under the system of the present invention, a player sitting at a gaming machine that is not eligible can continue to conventionally play the game even though the machine cannot participate in the bonus mode. Such playing will result in contributions to the next bonus pool based upon the coins in made by that player in playing the conventional game.

In the event the gaming machine in stage 965 is eligible, a determination is made as to whether or not it is selected. In the present invention not all eligible gaming machines are selected for a jackpot bonus award as previously discussed. Hence, in stage 970, even though the gaming machine is eligible E, it may not be randomly selected S to receive a bonus opportunity BO (i.e., catch a potato), as discussed above. If it is not randomly selected S, then the coin in is treated as a normal coin in acknowledgement in stage 975. If the eligible gaming machine E is selected S, then stage 980 is entered wherein the selected gaming machine receives a bonus multiple opportunity—a multiple of the payoff, if any, resulting at the end of the game. In stage 980, controller 30 does not wait for the game to be played, but rather stores in suitable memory this information so that when this selected gaming machine is again accessed and a game result is delivered to the controller 30, the controller 30 knows that this selected machine S is entitled to receive a multiple jackpot payoff. If a win does not occur, then stage 985 is entered and a determination is made as to whether or not the count for the bonus opportunities, BO equals zero. If a win occurs in stage 980, then stage 982 is entered and the current value is reduced by the amount of the win. In stage 984 a determination is made whether the current value is greater than zero. If it is, then stage 985 is entered. If not, then the bonus mode in stage 986 is entered which ends the bonus mode and which returns to stage 910. For example and with reference back to FIG. 8, assume the bonus multiple BM equals 2× and the game count is set equal to twenty (i.e., BO=20), then when a counter has been decremented from twenty to zero in stage 985, then the controller checks to see if the current bonus round BR is the last bonus round BR. If the count does not equal zero in stage 985, the system returns to stage 920 waiting for the next coin in amount information. If it is not the last bonus round in stage 990, then the bonus multiplier is set to the next value such as BM=3× in stage 992, and the process continues for the game count (i.e., value of BO) for this BM value going down to zero in stage 985 which in the example of FIG. 8 is 15 (corresponding to BM=3×). It is to be expressly understood that cycling through the BO count in stage 985. In all cases, the bonus mode will end whenever the current value drops below the zero value in the system as discussed earlier, as shown in stage 986.

FIG. 9 represents one preferred embodiment to functionally program the controller 30 to communicate over network 32 with the interface cards 34 at each gaming machine G. Other functional embodiments implementing the teachings of the present invention could also be used.

13. Multimedia Presentations in Display D

In the displays D of each gaming machine G, the following sets forth the operation by the controller 30 of what is presented in each display D. The display D is preferably a liquid crystal display, but can be any type of display such as a video monitor with or without sound effects. In the preferred embodiment there is also a speaker associated with the display.

Figure 10:
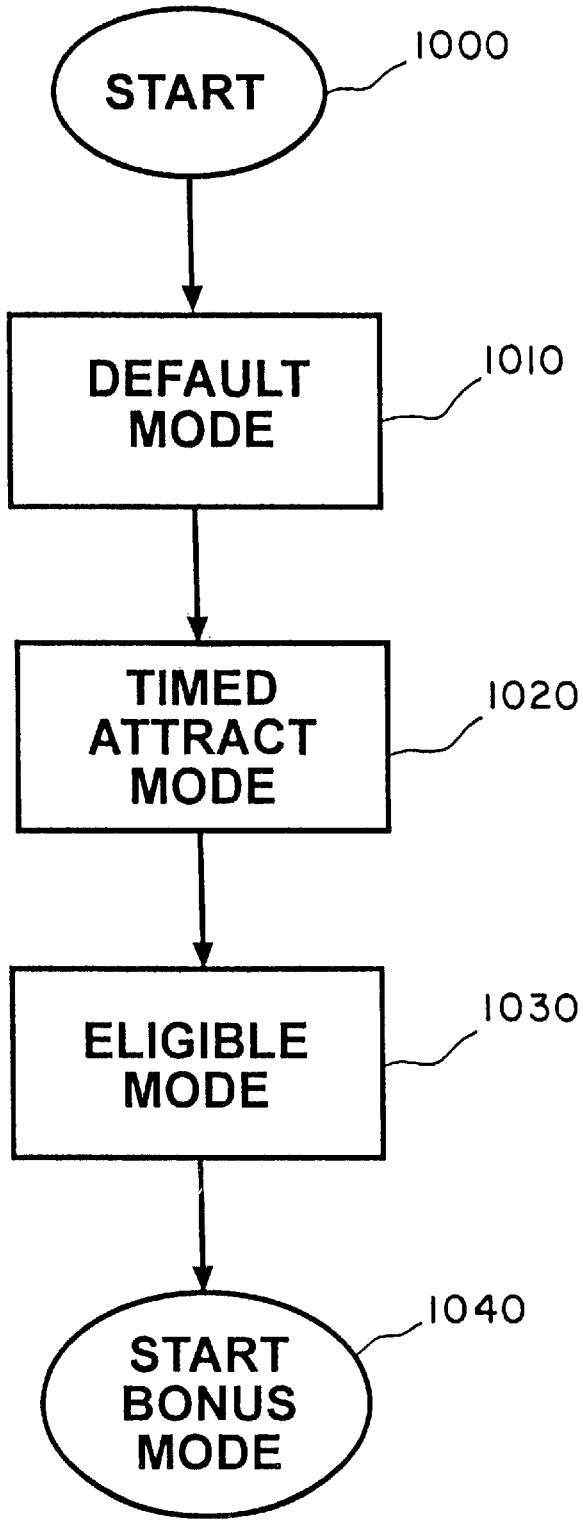
FIG. 10 is a functional flow chart showing the media presentation before the bonus mode time period starts.

In FIG. 10, when the system of the present invention is not in the bonus mode, the games G are played conventionally. The system is started in stage 1000 and in stage 1010 a default mode presentation is made in display D. This may be one or a number of still images with or preferably without sound. Occasionally, from time to time stage 1020 is entered which is a timed attract mode stage wherein animation is graphically displayed in the display D with or, in the preferred embodiment, without sound. Finally, in stage 1030 a still image indicating eligibility preferably with sound occurs. This enables a player to easily ascertain whether or not they have met the eligibility requirements, examples of which are set forth in FIG. 4.

When the bonus mode starts, stage 1040 is entered. It is to be expressly understood that any of a number of suitable multimedia displays could occur in display D in each gaming machine. A player quickly ascertains that they have achieved "eligibility." The multimedia presentation to the player at stage 1030 occurs so that that player knows they are eligible to participate in the bonus mode when it occurs. When a player is not in an eligibility mode or when a machine is simply idle and not being played, stage 1010 and 1020 are entered. Also, a player sees that they have caught a potato before the game ends.

Figure 11:
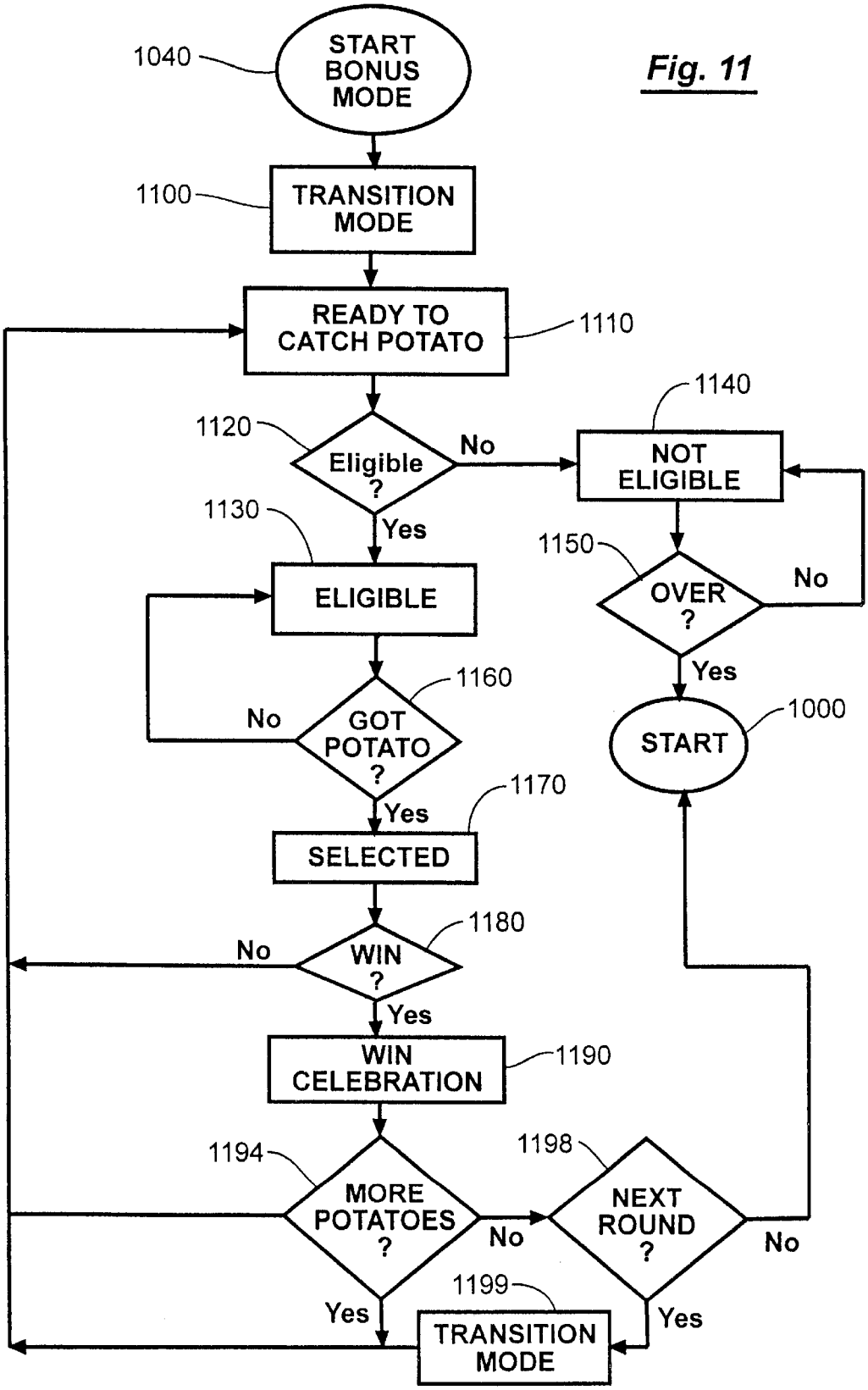
FIG. 11 is the functional flow chart of the operation during the bonus mode time period.

In FIG. 11, the system 10 of the present invention has entered the start bonus mode in stage 1040. A transition mode is entered in stage 1100 in which the display D for a period of time such as five seconds (or any other suitable time) provides transition animation. Then the system enters stage 1110 wherein the eligible machines E are identified and are internally made ready to catch the potato (i.e., receive a bonus opportunity BO). In the event secondary eligibility is required, then stage 1120 is entered. This is discussed with respect to FIG. 4. As long as a player maintains secondary eligibility 1120, if required, he/she receives in stage 1130 a display in display D that shows eligibility. In the preferred embodiment, there are six bonus rounds BR and, therefore, a different multimedia presentation or still image for each bonus round BR can be displayed in display D indicating eligibility. If a player is not able to maintain secondary eligibility in stage 1120, the system enters stage 1140 and displays in display D hands down 20*a*. The player, however, in one variation of the present invention can regain eligibility as discussed for the next bonus round by continuing to play. When the bonus mode is detected to be over in stage 1150, then that machine re-enters the start stage 1000 of FIG. 10.

Returning to stage 1130 where the controller 30 has determined that secondary eligibility has been maintained, the decision is made in stage 1160 whether or not the gaming machines E has been randomly selected S to get a potato (i.e., to receive a bonus opportunity BO). If the machine E has not been randomly selected, then stage 1130 is re-entered. If the gaming machine has been randomly selected, then stage 1170 is entered. For each game start signal (i.e., at $T_{GS}$), the determination of random selection for the gaming machine is made. Hence, even though a player starting a particular game is not randomly selected, it is entirely possible that that player will be selected the next game. The selected gaming machine S then receives in its display FIG. 2(*d*) and the player knows it has caught the potato. Whether or not the selected gaming machine S wins a jackpot bonus payoff is dependent upon the outcome of the game. Hence, in stage 1180, when the outcome is a win, then stage 1190 is entered and a suitable win celebration multimedia presentation is made in display D. At the end of this multimedia display presentation, for example, the display D can show a hand throwing the potato back. The win celebration can also display the bonus multiples BM such as 2×, 3×, etc. In the event there is not a win in stage 1180, the system returns the selected machine to stage 1110. Stage 1194 is the stage in which the system determines the game count or whether or not any more potatoes (i.e., bonus opportunities BO) are to be delivered in this round. Stage 1198 determines which bonus round BR the system is in.

Hence, in FIG. 11, the various multimedia presentations in display D are set forth for the teachings of the present invention. Graphical displays are made at the gaming machine so that a player can readily determine whether or not they have maintained eligibility during the bonus mode time period (stages 1130 and 1140), whether or not the machine is selected in stage 1170, and whether or not a win occurs in stage 1190. Each new round 1198 enters stage 1199 and brings up different multimedia presentations to add excitement to the game and to inform the players which bonus round BR (i.e., 2×, 3×, 4×, etc.) the bonus mode time period is in. A similar functional flow chart exists for the overhead display 70 and sound system 60. If the bonus rounds are over in stage 1198, then start 1000 is entered.

Figure 2A:
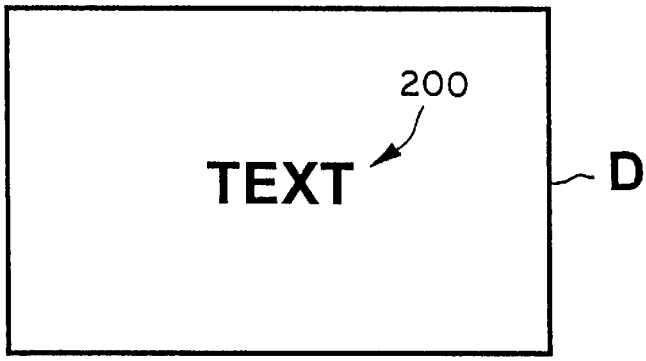
FIGS. 2(*a*), 2(*b*), 2(*c*), and 2(*d*) illustrate a multimedia presentation for play of the present invention displayed in each of the gaming machines for the embodiment of FIG. 1.
Figure 2B:
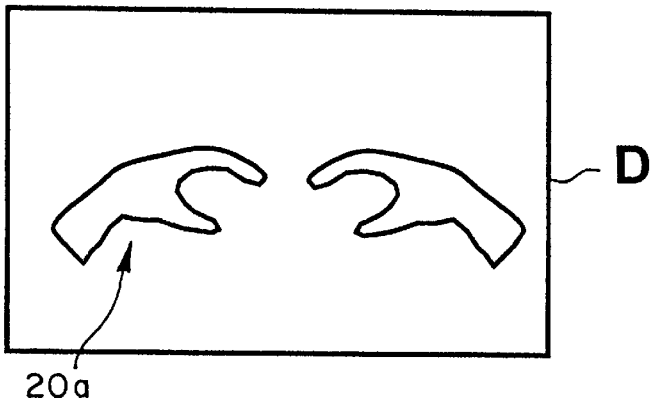
Figure 2C:
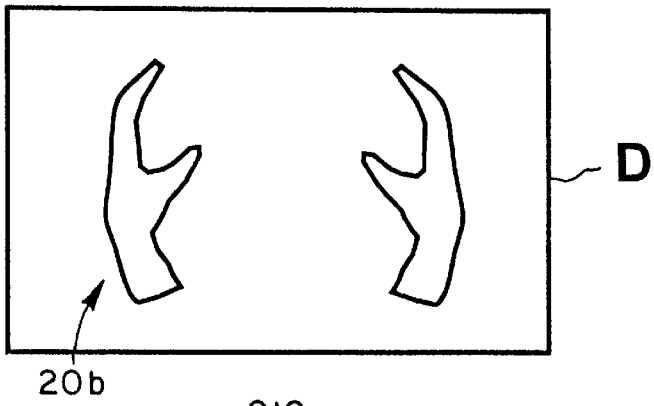
Figure 2D:
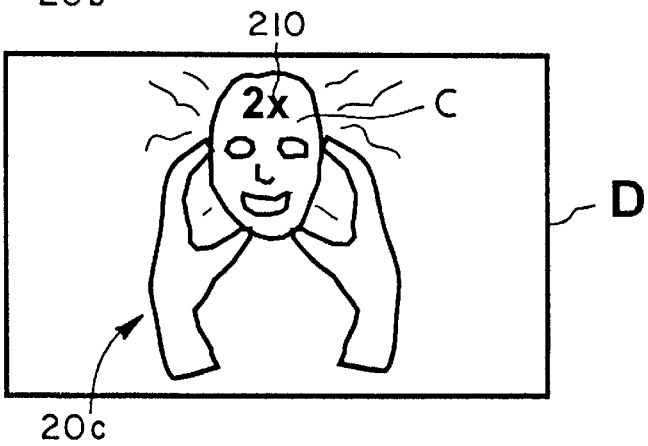
Figure 12A:
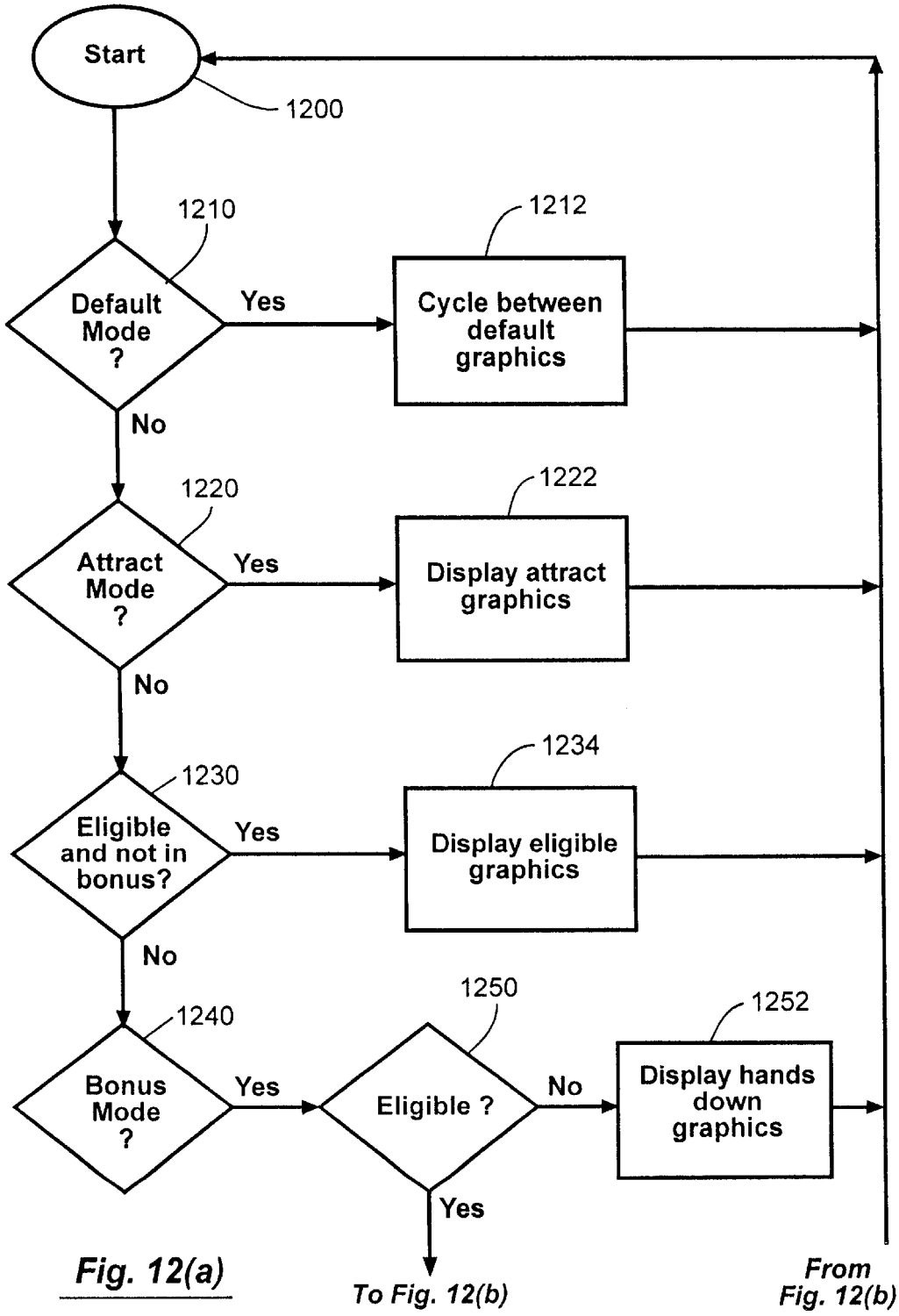
FIGS. 12(*a*) and 12(*b*) are functional flow charts for the operation of the displays.
Figure 12B:
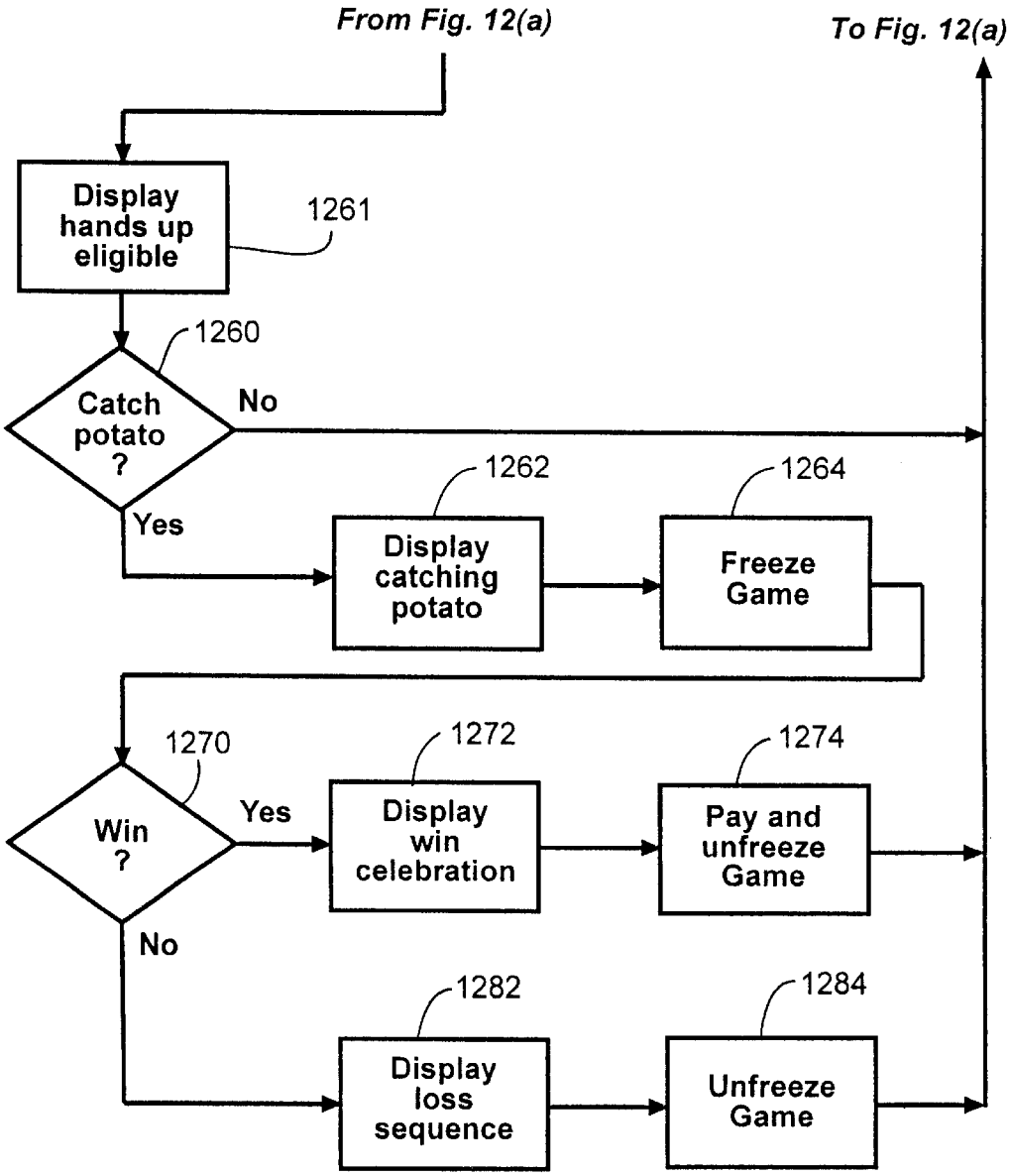

In FIGS. 12(*a*) and 12(*b*), the functional operation of the multimedia presentation in the interface 34 of each gaming machine is shown. The functional flow chart starts at stage 1200. When the interface, which may include a microprocessor-based or personal computer-based system, enters the default mode 1210, a determination is made whether to cycle between default graphics in stage 1212 for display in display D and activation of speakers 24 or to enter stage 1220. In stage 1220 which is an attract mode, attract graphics are displayed in stage 1222 in display D and suitable sounds in speaker 24. If the gaming machine G is eligible E but not in the bonus mode stage, then 1230 is entered. Display graphics are displayed in stage 1234 which would, for example, correspond to textual material 200 shown in FIG. 2*a* in display D. If the system is in the bonus mode, then stage 1240 is entered. Once in the bonus mode, if in stage 1250, the machine is not eligible, then in stage 1252 the hands down 20*a* of FIG. 2*b* are displayed. If the gaming machine is eligible, then stage 1261 is entered to display hands up 20*b* eligibility and stage 1260 is entered. If gaming machine is selected S, then stage 1262 is entered showing the display of FIG. 2*d* and a potato C being caught by the hands 20*c*. This display continues in stage 1264 until the end of the game. At the end of the game, stage 1270 is entered and, if it is a win, then a display win celebration is set forth in stage 1272 and in stage 1274 a payout occurs and the underlying game is unfrozen. If the outcome of the game is a loss, then stage 1282 is entered in which a display loss media presentation is set forth in speaker 24 and display D in stage 1282 and then in stage 1284 the game is unfrozen. Should an eligible machine not catch a potato in stage 1260, then start 1200 is re-entered.

Figure 13:
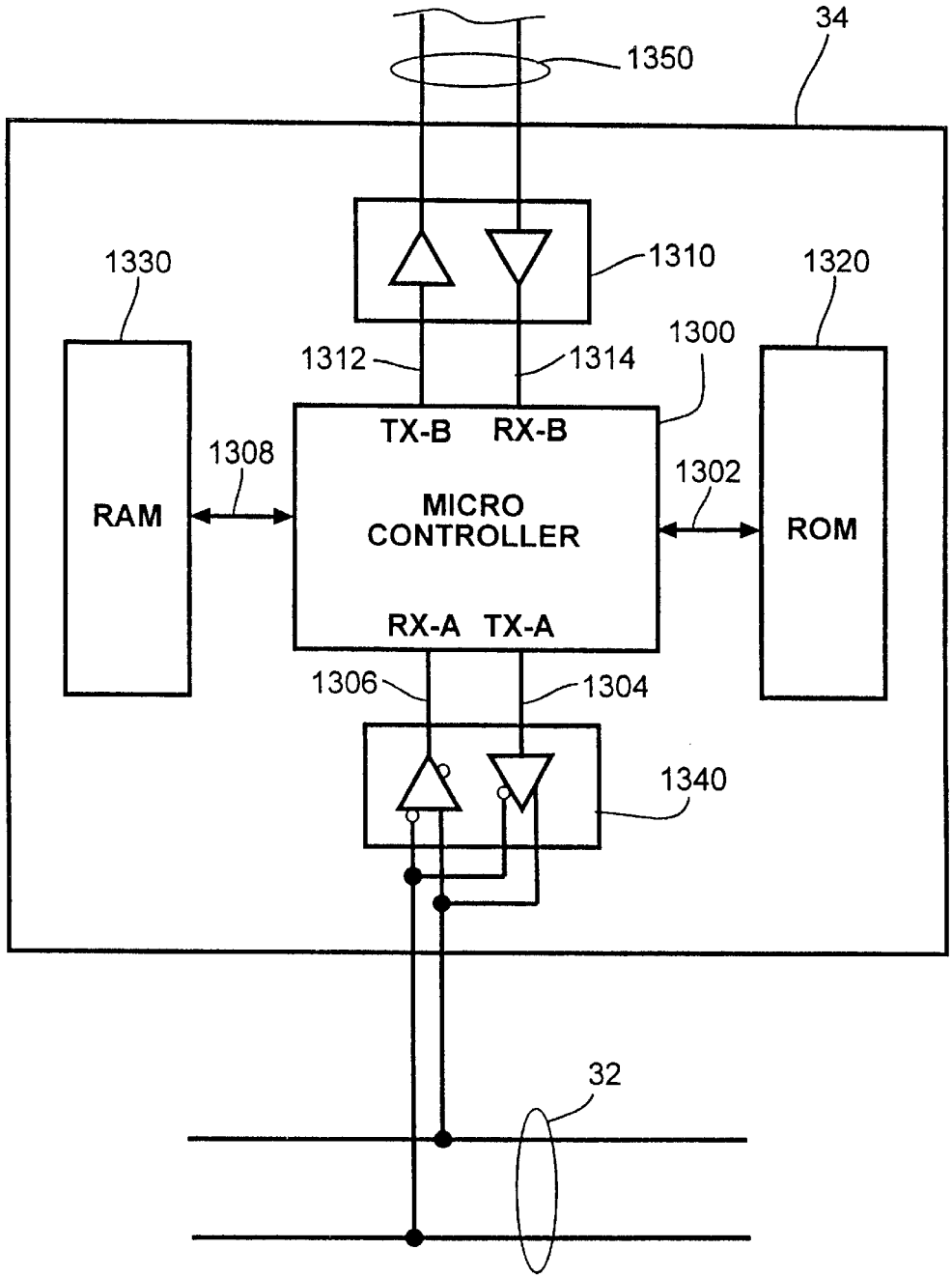
Fig. 13 ( Prior Art )
FIG. 13 is a prior art interface card.

In FIG. 13, the details of a preferred embodiment for an interface card 34 are set forth. A micro controller 1300 is shown interconnected to machine serial interface 1310, read only memory (ROM) 1320, a controller network serial interface 1340, and random access memory (RAM) 1330. All of these components are conventionally available. The micro controller 1300 can be any central processing unit and communicates with the gaming machine G over conventional serial transmit line 1312 and receives signals over a conventional serial receive line 1314. The micro controller 1300 also receives programming commands over line 1302 from ROM 1320. Likewise, the micro controller 1300 receives serial signals from the controller 30 over lines 1306 and transmits serial signals to the controller 30 over lines 1304. Finally, the micro controller has two-way communication over lines 1308 with RAM 1330.

To connect each gaming machine G to the controller 30, it is commonly accepted that an interface board 34 may be employed. The interface board 34 supports a suitable interface 1340 connection to the controller 30 via the controller communications network 32. Also, the interface board 34 supports a suitable interface 1310 for connecting the interface board to the gaming machine G.

It is commonly accepted that such interface boards 34 are used in the gaming industry to aid in the process of interfacing games G to one common network. In many cases, gaming machines G supporting different communications protocols are linked to one common controller 30. In such cases, it is conventional to support suitable software in ROM 1320 within the interface board 34 that converts each gaming machine's specific protocols into one common network protocol to simplify controller design and operation.

Furthermore, the complex process of polling and communicating to both the controller network 32 and gaming machine G require additional software support in ROM 1320 within the interface board. It is common that when the controller 30 sends a command to a particular gaming machine G, by means of example to command that a gaming machine pay a bonus, that such command will be received by the interface board 34, temporarily stored in its RAM 1330, and then resent to the gaming machine G in a suitable protocol understood by the gaming machine G.

The interface board 34 disclosed in the present invention does not act to store a secondary pay table, or otherwise influence the operation of the gaming machine G in any fashion other than to recommunicate the commands sent by the controller 30 to the gaming machine G, or information sent by the gaming machine G to the controller 30. While additional messages may be exchanged between the game G and the interface board 34, these commands are to secure the information required between the gaming machine G and the controller 30 for the operation disclosed herein.

The present invention 10 need not include an interface board 34, and gaming machines G linked to such a controller embodiment could be programmed to communicate directly to the controller without any protocol translation or interface board support. In this case, the gaming machine G will correctly handle all communications timing needs, while protocol translation is not required. These items expressed above are commonly accepted practice and as shown in FIG. 13 are well understood in the industry.

The above disclosure sets forth a number of embodiments of the present invention. Those skilled in this art will however appreciate that other arrangements or embodiments, not precisely set forth, could be practiced under the teachings of the present invention and that the scope of this invention should only be limited by the scope of the following claims.

I claim:

1. A method for providing bonus jackpot payoffs during a bonus mode time period in a system of linked gaming machines participating in the bonus mode time period interconnected to a controller, said method comprising the steps of:

providing bonus rounds in the controller wherein each bonus round has a different bonus multiplier and wherein each bonus round has a different predetermined number of bonus multiplier opportunities corresponding to the bonus multiplier for each bonus round, issuing at most the predetermined number of bonus multiplier opportunities during each bonus round from the controller to the participating gaming machines, the controller awarding a bonus jackpot payoff based on the issued bonus multiplier opportunity.

2. The method of claim 1 further comprising the steps of:

starting the bonus mode time period when a bonus pool of monetary value occurs, decrementing the monetary value in the bonus pool by each bonus jackpot payoff awarded, ending the bonus mode time period when the monetary value in the bonus pool drops below a predetermined low value.

3. The method of claim 2 wherein the predetermined low value is zero.

4. The method of claim 1 wherein the bonus multiplier is different for each successive bonus round.

5. The method of claim 1 wherein the predetermined number of bonus multiplier opportunities is different for each successive bonus round.

6. The method of claim 1 further comprising the step of ending a bonus round when the predetermined number of bonus multiplier opportunities for the aforesaid round have been issued.

7. The method of claim 1 wherein the predetermined number of bonus multiplier opportunities for a bonus round is randomly selected in predetermined range of numbers.

8. The method of claim 1 further comprising the step of randomly selecting the number of bonus rounds at the start of the bonus mode time period in a predetermined range of numbers.

9. The method of claim 1 wherein the bonus multiplier increases for each successive bonus round and wherein the predetermined number of bonus multiplier opportunities decreases for each next bonus round.

10. The method of claim 7 further comprising the step of displaying bonus mode time period eligibility status in a display at the participating gaming machine during play of the participating gaming machine during the bonus mode time period.

11. The method of claim 1 wherein any awarded bonus jackpot payoff does not exceed a maximum value.

12. The method of claim 1 wherein any awarded bonus jackpot payoff award is made for only designated lower valued game payoffs.

13. A method for providing bonus payoffs during a bonus mode time period in a system of linked eligible gaming machines interconnected to a controller, said method comprising the steps of:

providing a fixed number of bonus rounds, assigning a bonus multiplier for each of the fixed number of bonus rounds, providing a predetermined number of bonus multiplier opportunities for each of said fixed number of bonus rounds, each bonus multiplier opportunity corresponding to the bonus multiplier assigned for each bonus round, starting the bonus mode time period with a bonus pool of monetary value, each said bonus round comprising at least the following steps in any order:

awarding a bonus jackpot payoff at least based on the bonus multiplier assigned to the received bonus multiplier opportunity, deducting the awarded bonus jackpot payoff value from the monetary value of the bonus pool, ending the aforesaid bonus round when all of the predetermined number of bonus multiplier opportunities are delivered, ending the bonus mode time period when all of the fixed number of bonus rounds have occurred or when the monetary value in the bonus pool drops below a predetermined low value.

14. The method of claim 13 wherein the predetermined low value is zero.

15. The method of claim 13 wherein the predetermined number of bonus multiplier opportunities is randomly selected in a predetermined range of numbers.

16. The method of claim 13 wherein the bonus multiplier increases for each successive bonus round and wherein the predetermined number of bonus multiplier opportunities decreases for each successive bonus round.

17. The method of claim 13 wherein any awarded bonus jackpot payoff award does not exceed a maximum value.

18. The method of claim 13 wherein any awarded bonus jackpot payoff award is made for only designated lower valued game payoffs.

19. A method of controlling the length of the average bonus mode time period for a bonus game having a plurality of linked gaming machines interconnected to a controller, said bonus mode time period funded by a bonus pool of monetary value, said method comprising the steps of:

providing to the controller at least the following values: a fixed number of bonus rounds, a bonus multiplier for each of the fixed number of bonus rounds, a predetermined number of bonus multiplier opportunities for each of the fixed number of bonus rounds, each bonus multiplier opportunity corresponding to the bonus multiplier assigned for each bonus round, and a random selection rate for each bonus round for delivering a bonus multiple opportunity to each eligible gaming machine at the start of a game in the aforesaid each eligible gaming machine, the aforesaid values controlling the average length of the bonus mode time period, playing the bonus game from the controller by issuing bonus multiplier opportunities to each eligible gaming machine at the start of each game, ending the bonus mode time period when all of the fixed number of bonus rounds have occurred or when the monetary value in the bonus pool drops below a predetermined value.

20. The method of claim 19 further comprising the step of:

providing in the controller a transition time between bonus rounds.

21. The method of claim 20 further comprising the step of:

presenting a multimedia presentation during the transition time announcing the next bonus round.

22. The method of claim 19 wherein the value of the bonus multiplier increases each successive bonus round.

23. The method of claim 19 wherein the value of the bonus multiplier opportunities decreases each successive bonus round.

24. The method of claim 19 wherein the value of the random selection rate is static.

25. The method of claim 19 wherein the value of the random selection rate is a number of eligible gaming machines at the start of the bonus mode time period so as to increase randomness.

* * * * *